US010371045B2

(12) United States Patent
Johnson

(10) Patent No.: US 10,371,045 B2
(45) Date of Patent: Aug. 6, 2019

(54) FREE-PISTON ENGINE

(71) Applicant: Alan Kent Johnson, Oak Forest, IL (US)

(72) Inventor: Alan Kent Johnson, Oak Forest, IL (US)

( * ) Notice: Subject to any disclaimer, the term of this patent is extended or adjusted under 35 U.S.C. 154(b) by 139 days.

(21) Appl. No.: 15/815,779

(22) Filed: Nov. 17, 2017

(65) Prior Publication Data

US 2019/0153936 A1 May 23, 2019

(51) Int. Cl.

| | |
|---|---|
| ***F02B 71/04*** | (2006.01) |
| ***F02B 33/04*** | (2006.01) |
| ***F01L 1/14*** | (2006.01) |
| ***F01L 1/38*** | (2006.01) |
| ***F01M 1/06*** | (2006.01) |
| ***F01L 9/02*** | (2006.01) |

(52) U.S. Cl.

CPC ..... *F02B 71/04* (2013.01); *F01L 1/146* (2013.01); *F01L 1/38* (2013.01); *F01L 9/023* (2013.01); *F01M 1/06* (2013.01); *F02B 33/04* (2013.01); *F01M 2001/066* (2013.01)

(58) Field of Classification Search

CPC ..... F02B 71/04; F02B 33/02; F02B 33/04; F02B 33/06; F02B 33/12; F02B 33/18; F02B 33/22; F01L 1/146; F01L 1/38

See application file for complete search history.

(56) References Cited

U.S. PATENT DOCUMENTS

| | | | | |
|---|---|---|---|---|
| 2,478,375 | A | 8/1949 | Davis | |
| 2,916,025 | A | 12/1959 | Klotsch | |
| 3,694,111 | A | 9/1972 | Braun | |
| 3,868,932 | A | 3/1975 | Toth | |
| 4,907,548 | A | 3/1990 | Lee | |
| 5,287,827 | A | 2/1994 | Almendinger et al. | |
| 6,170,442 | B1 | 1/2001 | Beale | |
| 6,199,519 | B1 | 3/2001 | Van Blarigan | |
| 8,104,436 | B2 | 1/2012 | Gary, Jr. | |
| 8,453,612 | B2 | 6/2013 | Simpson et al. | |
| 8,622,032 | B2 | 1/2014 | Rez | |
| 9,080,498 | B2 | 7/2015 | Rez | |
| 2013/0269634 | A1* | 10/2013 | Rez | F02B 75/32 123/41.37 |

OTHER PUBLICATIONS

R. Mikalsen, A.P. Roskilly, "A review of free-piston engine history and applications", Applied Thermal Engineering, Oct. 2007, pp. 2339-2352, vol. 27, Issues 14-15, Elsevier, U.K.

Michael Leick, Ronald Moses, "Experimental Evaluation of the Free Piston Engine-Linear Alternator (FPLA)", Sandia Report, Mar. 2015, SAND2015-2095 569665, OSTI Identifier 1177159, Sandia National Laboratories, Albuquerque, NM (United States).

* cited by examiner

*Primary Examiner* — Jacob M Amick

(57) ABSTRACT

A multicylinder internal combustion free-piston engine (FPE) with synchronized reciprocating plungers. The invention provides a solution for the problem of the slow engine speed typical of FPE's with heavy plunger mass. Bounce chambers fitted with sleeve valves control the engine's speed and stroke length. The invention's configuration prevents piston head-strikes and operates at standard compression ratios. Piston "pop-top" intake valves allow uniflow scavenging and connecting rod oil channels provide lubrication with no combustion chamber contamination. Poppet combustion head valves are operated by linear cams attached to the plungers. Hydraulic valve actuators implement variable valve timing under computer control.

12 Claims, 25 Drawing Sheets

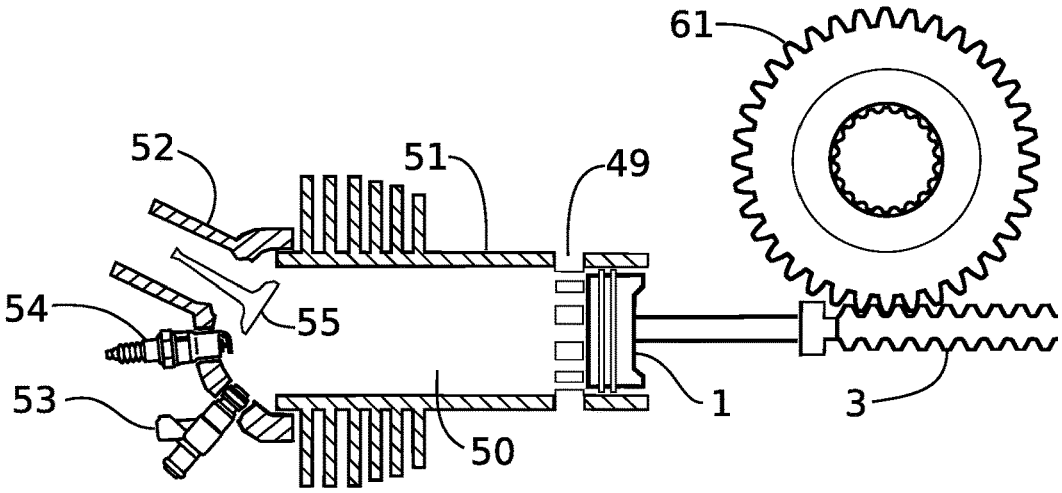
FIG. 31
FIG. 32
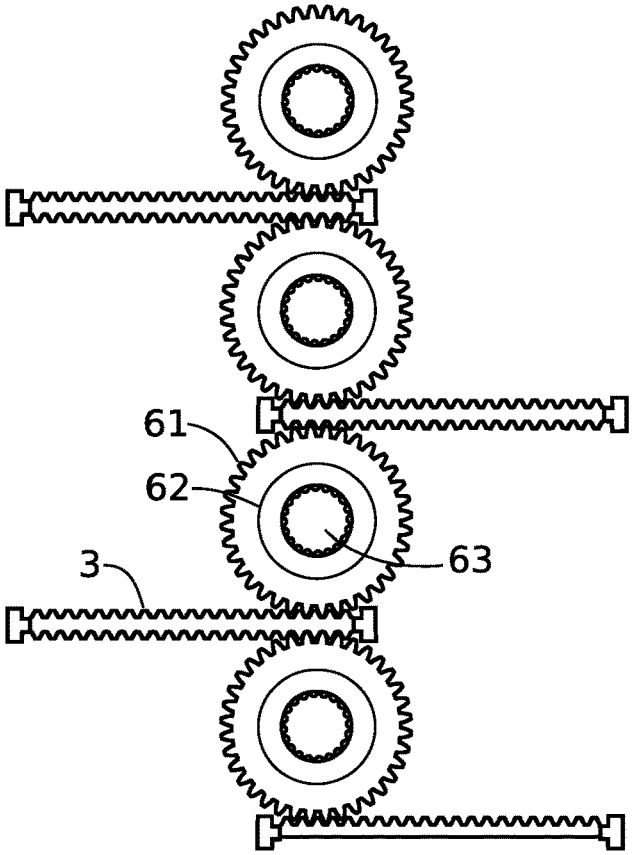

FREE-PISTON ENGINE

TECHNICAL FIELD

The present invention relates generally to the field of internal combustion free-piston engines. More specifically the present invention relates to a multi-cylinder internal combustion free-piston engine capable of operating at a high cycle rate even with a heavy reciprocating mass, and capable of operating at an adjustable cycle rate.

BACKGROUND

Internal combustion engines of the free-piston type are known and have been successfully manufactured as air compressors, gas generators for turbine engines, and as hydraulic pumps. These types may be called "conventional" free-piston engines. Difficulties have prevented the technology from expanding to other configurations. A large body of literature exists on the potential of using an internal combustion free-piston engine (FPE) to drive a linear electric generator. Attempts have also been made to convert the reciprocating action of a free-piston engine directly to rotational power by use of rack-and-pinion mechanisms. In this disclosure these types will be called "advanced" free-piston engines. Neither of these types, the electric generator or rack-and-pinion types, has been successfully implemented. Producing useful power levels from advanced designs has proved especially difficult. One reason for the under-powered performance of advanced FPE designs is that they require reciprocating plungers of significantly heavier weight than conventional FPE's.

FIG. 2 and FIG. 4 are presented here for explicating problems inherent with advanced free-piston engine design. FIG. 2 shows a plunger assembly of mass m reciprocating between a combustion chamber 50 and a bounce chamber 30. The following analysis applies to most all FPE configurations. For example, the plunger may reciprocate within two combustion chambers, or two plungers may operate opposed to each other. An opposed-piston FPE may have either a single combustion cylinder or dual combustion cylinders. FIG. 4 shows the force curve on bounce piston 16 and power piston 1 during the compression stroke, with the horizontal axis showing piston displacement. The graph is drawn for a chamber six units in length so that a piston displacement of five units produces a compression ratio (CR) of 6 to 1. The compression ratios at various piston displacements are marked on the force curve. The vertical axis shows normalized force units. Note that graph is broken into two sections and that the force scale at the top of the vertical axis is more compressed than the lower section.

Referring to FIG. 2 we consider the operation of the engine at idle with no load, and burning only enough fuel to overcome friction. The system operates as a spring-mass oscillator with a gas-spring at each end of the reciprocating mass. Consider the idling engine operating with stroke length SL that produces a 7.5 to 1 compression ratio. Lines TC (top-center) and BC (bottom-center) mark the outboard and inboard reversal points of piston travel, respectively. Point TC is marked on the force curve in FIG. 4. It can be observed that the curve's tangent at point TC, shown by the dashed line, is a good linear approximation of the force curve between compression ratios of 6:1 and 10:1. Therefore the system closely follows the behavior of a simple harmonic oscillator for stroke lengths within these compression ratios. The resonant frequency of the system, co, is known to have the formula:

$$\omega=\sqrt{(K/m)} \quad (1)$$

where K is the system's spring constant. The value of K is expressed in the slope of the tangent line in FIG. 4.

Formula (1) makes evident that increasing values of m (mass) produce decreasing cycle rates. Furthermore, the idling cycle rate is the maximum cycle rate of the engine because linkage to a load only dampens and slows the oscillation regardless of fuel burn. FPE designs having heavy plunger weights thus tend to suffer low engine speeds and low power performance. If an automotive sized FPE is limited to a cycle rate of only a hundred or so cycles per minute, it is not capable of producing a power level comparable to conventional internal combustion engines.

In order to increase the inherently slow cycle rates of advanced FPE models researchers typically run the engines at very high compression ratios. As is evident in FIG. 4, the slope of the air-spring force curve, and therefore cycle rate of the system, increases dramatically for compression ratios above 30 to 1. For example, U.S. Pat. No. 6,199,519 (Mar. 13, 2001) describes the testing of an advanced FPE at Sandia National Laboratory. An acceptable engine speed of 40 Hz, equivalent to 2400 rpm, was attained but only at compression ratios as high as 40 to 1. U.S. Pat. No. 8,453,612 (Jun. 4, 2013) describes testing of an advance FPE at Stanford University at compression ratios between 30:1 and nearly 100:1. But such high compression ratios are not practical for an internal combustion engine.

Another method for increasing the cycle rate of a heavy mass FPE is to increase the engine's piston diameters. Increasing the piston diameters increase the spring constant K of the system's air-springs. Referring to FIG. 2, increasing the diameter of bounce piston 5 may be a practical design option. Bounce chambers can be enlarged without increasing pumping losses because no gas exchange takes place in the chamber. Furthermore, complex mixing and combustion processes do not occur in the bounce chamber. Both power and bounce piston diameters must be enlarged together, however, for this method to work. Compression ratios in the combustion chamber become extreme if the bounce piston diameter alone is increased. But to attain useful cycle rates at reasonable compression ratios this method yields unworkably large combustion chambers (50).

Control of the engine's stroke length has also proved problematic for advanced FPE's designed to run at standard compression ratios. The force curve shown in FIG. 4 reveals that, at standard engine compression ratios, piston stroke variation of one or two tenths of inch produces little force differential. That is, small variations in the oscillating system's energy produces large variations in stroke length. This trait leads to a common problem in advanced FPE's: piston head-strikes. A piston striking the combustion cylinder head is a damaging failure that must be prevented in practice. Researchers commonly attempt to control stroke length in advanced FPE designs, and avoid head-strikes, by implementing very precise stroke-by-stroke control of the engine's fuel injectors and combustion timing. At Sandia National Laboratory complex mechanisms have been used to inject high pressure helium or nitrogen gas into the bounce chambers, on a stroke-by-stroke basis, in order to control stroke length. These methods are complex and costly, and have not been sufficiently developed.

A further disadvantage of current advanced FPE designs is their fixed engine speed. The cycle rate of FPE's is determined by the resonant frequency according to formula (1) and varies very little with engine power. It would be desirable for an advanced FPE to be operable over a range of cycle rates while maintaining compression ratios at moderate levels. It would even be desirable for the engine to be switchable between two spring constants: one for low speed idle and engine starting and a second for high speed operation.

Associated with the control issues described above is the operation of the combustion chamber gas valves in advanced FPE's. Many designs use externally powered poppet valve mechanisms. This approach adds cost and complexity to the engine and reduces efficiency. Designs that operate valves directly from plunger movement suffer the disadvantage of fixed valve timing that is difficult to adjust. An additional issue associated with advanced FPE's involves the two-stroke engine cycle. Other than in large marine engines, the two-stroke engine cycle is commonly implemented in a manner that produces worse exhaust emissions and lower thermal efficiency than four-stroke engines. Current advanced FPE designs have not sufficiently addressed this issue.

Finally, advanced free-piston designs are usually limited to single cylinder configurations. Opposed-piston types are limited to two combustion chambers and reciprocating plungers. Additionally, cumbersome mechanical linkages are needed to synchronize the plungers in opposed-piston FPE's. Adding combustion cylinders to current advanced FPE models is usually accomplished by ganging together independently reciprocating units. The scheme suffers serious vibration issues because the motion of the plungers is unsynchronized. A multicylinder free-piston engine configuration in which the multiple plungers are synchronized would substantially increase power generation.

BRIEF SUMMARY OF THE INVENTION

The present invention is an internal combustion engine of the free-piston type designed to operate a heavy weight reciprocating plunger. The plunger may comprise, or may link to, a power transmission device such as a linear electric generator or a rack-and-pinion drive mechanism. These types of mechanisms most often require a heavy weight plunger.

It is an objective of the invention to achieve higher engine cycle rates than is currently possible in a free-piston engine having heavy reciprocating plungers. It is an objective of the invention to achieve this higher cycle rate while maintaining a combustion chamber compression ratio in the standard range for internal combustion engines. It is a further object of the invention to achieve this higher cycle rate with power piston diameters that are in the standard range for an automotive or aviation type combustion engine. The invention achieves these objectives by making use of large diameter bounce pistons while simultaneously keeping the power pistons at a smaller, practical diameter. This achievement is made possible by a mechanical linkage that pairs the compression stroke of each power piston with the compression stroke of at least one bounce piston.

It is a further object of the present invention to attain variable engine speed and, for a selected engine speed, to attain an adjustable plunger stroke length. The invention achieves these objectives by controlling the amount of air trapped in the bounce chambers during the bounce piston compression strokes. Ports on the inboard portion of the bounce cylinder are adjusted by sliding cylindrical sleeve valves over the ports. The position of the sleeve valves effectively controls the spring constant of the bounce chamber, thus controlling the engine's speed and stroke length.

Another object of the invention is to prevent the power piston from striking the head of the combustion chamber, or components of the combustion head, should an uncontrolled excursion of a piston stroke occur. A mechanical linkage between multiple reciprocating plungers in the current invention allows the positioning of the bounce chambers to limit the maximum top-center point (TCm) of power piston motion, thus preventing combustion head-strikes. The shaping of the bounce piston top and the shaping of the bounce cylinder ceiling of the current invention also prevents bounce piston head strikes.

An additional object of the present invention is to provide at least one gas valve for each combustion chamber head that is operated by the motion of the engine's reciprocating plungers. This objective is attained by providing a linear cam mechanism on the engine's plungers that operate one or more rocker arms. Motion of the plunger provides the force and motion for opening a poppet valve situated at the combustion chamber head. A further related object of the invention is to provide a variable duration for which the combustion head gas valve is open. This objective is attained by providing a electrically actuated hydraulic mechanism for controlling the timing of the valve's closure.

A further object of the invention to provide uniflow scavenging for the engine's two-stroke combustion cycle. This objective is attained by providing a source of pressurized scavenging air for each combustion chamber of the invention. Intake ports on the inboard side of the combustion cylinder and an exhaust port at the combustion head are provided. A double-acting power piston divides the combustion cylinder into a combustion chamber and pumping chamber. The intake ports allow air flow between the pumping cavity and a scavenging reservoir. The piston upstroke pulls air through a check valve into the scavenging reservoir. The piston downstroke compresses the air contained in the scavenging reservoir.

A further object of the invention is to provide power piston lubrication without allowing lubricating oil contamination of the combustion chamber. This objective is attained by providing a oil cavity around the circumference of the power piston. The oil cavity is sealed between two piston rings. Flow of lubricating oil enters the cavity via either one or both of two mechanisms. The first mechanism comprises an injector located on the combustion cylinder, operated so that oil is injected into the cavity as the piston passes under the injector. The second mechanism provides oil flow into the cavity through an oil channel in one of the piston's connecting rod. An additional connecting rod provides a channel for oil outflow from the cavity. A pop-top style poppet valve is provided in the power piston to provide for uniflow passage of scavenging air through the piston in a manner that prevents oil seepage into either the combustion chamber or scavenging air supply.

BRIEF DESCRIPTION OF THE DRAWINGS

Various embodiments are disclosed, by way of example only, with reference to the accompanying schematic drawings. Following standard practice, corresponding reference symbols of the drawings indicate corresponding parts:

FIG. 31 shows an alternative scavenging system for the present invention.

FIG. 32 shows an alternative configuration for implementing a four cylinder version of engine 100, having four rack and pinions.

DETAILED DESCRIPTION

Figure 1:
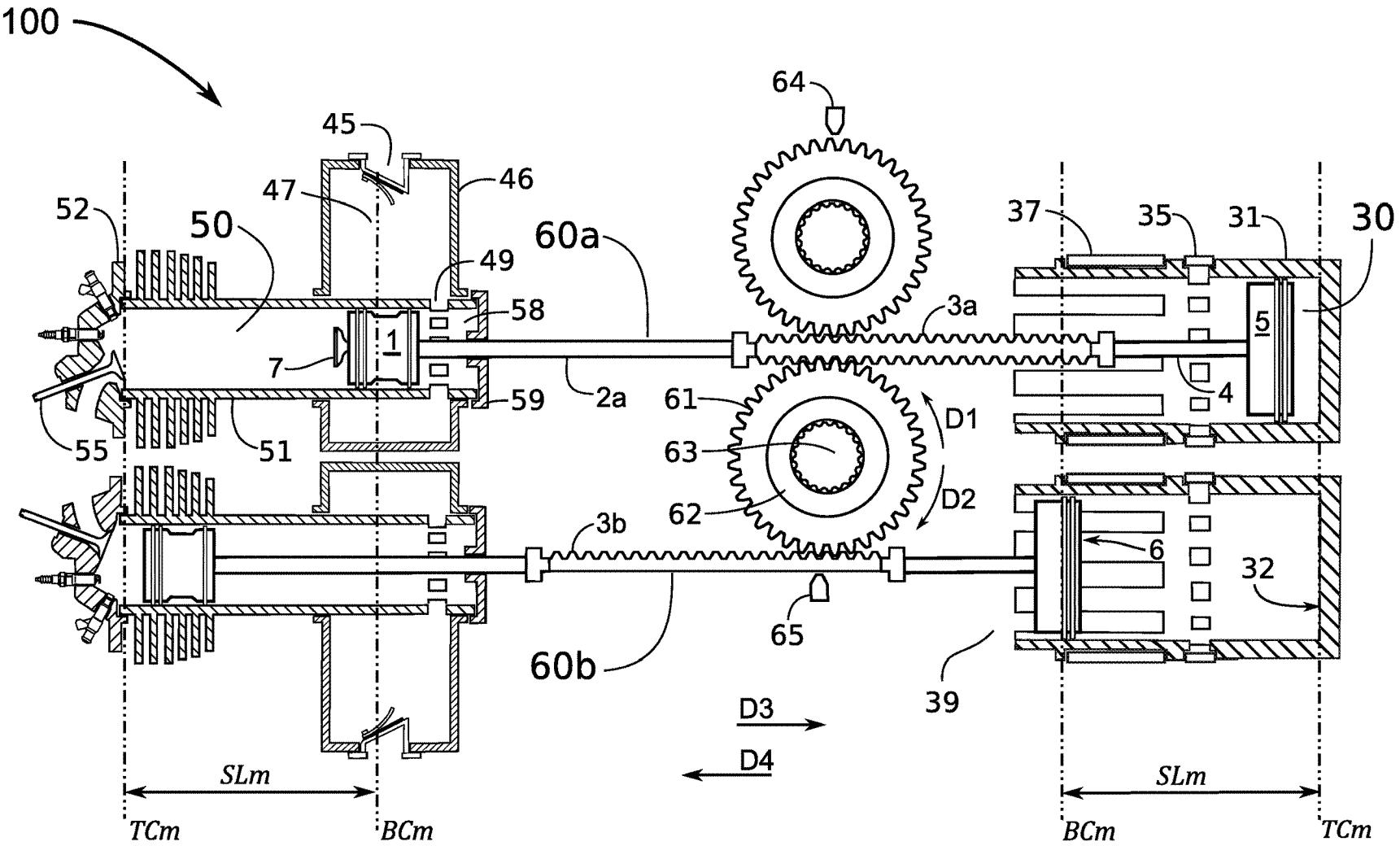
FIG. 1 is a partial longitudinal view of an exemplary embodiment of the present invention, engine 100.
Figure 2:
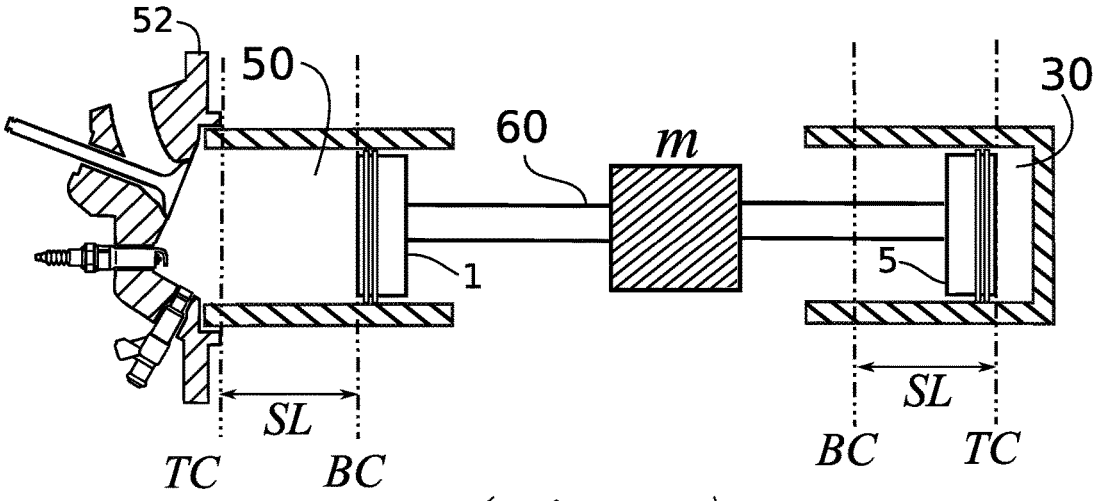
(prior art) FIG. 2
FIG. 2 is a longitudinal diagram of a typical internal combustion free-piston engine for demonstration of its reciprocating dynamics.

For the spatial terminology of the disclosure FIG. 1 will be used as the reference orientation. The following terminology is presented for descriptive purposes and is not meant to imply functionality. That is, for example, when the term "upper chamber" is used it does not imply that the engine must be orientated in practice with the identified "upper chamber" facing upwards. The terms "upper" and "lower" will refer to the top and bottom of FIG. 1. When discussing two parts having identical functions the suffix a and b may be attached to signify the upper part and lower part. For example, plunger 60*a* will designate the upper plunger and plunger 60*b* will designate the lower plunger. The term "inboard" will refer to directions D3 or D4 when the directions point toward the center of FIG. 1. The term "outboard" will refer to directions D3 or D4 when the directions point toward the left-most or right-most sides of FIG. 1. For example, combustion head 52 seals the outboard side of cylinder 51 and pumping head 59 seals the inboard side of cylinder 51. The term "downstroke" will be used for motion of a piston within its chamber in an inboard direction. "Upstroke" will be used for an outboard motion of a piston. The term "longitudinal" will refer to the axis parallel to directions D3 and D4. Although the present invention does not contain a crankshaft the following terms in common use for crankshaft engines will still be employed for clarity. The term "top-center" will refer to the outboard reversal point of a piston's reciprocating motion. The term "bottom-center" will refer to the inboard reversal point of a piston's reciprocating motion. When terms such as "four-cylinder engine" and "two-cylinder engine" are used they will describe the number of combustion chambers of the engine and not include the bounce chambers. Following standard practice, like drawing numbers on different drawing views of the several embodiments of the present invention will identify identical, or functionally similar, structural elements or components.

FIG. 1 shows a longitudinal cross section of an exemplary embodiment of the present invention, engine 100. Engine 100 comprises two combustion chambers 50, two bounce chambers 30, two reciprocating plunger assemblies 60, and two pinion gears 61. Upper plunger assembly 60*a* comprises power piston 1, connecting rods 2*a*, double sided gear rack 3*a*, connecting rods 4, and bounce piston 5. Lower plunger 60*b* is comprised of the same parts with the exception that single sided gear rack 3*b* may replace the double sided gear rack 3*a*. Upper and lower pinion gears 61 are rotatable about fix axes. The lower pinion gear engages gear rack 3*a* of the upper plunger and rack 3*b* of the lower plunger so that motions in the D3 direction of one plunger produces identical motions in the D4 direction of the other plunger. Each pinion gear engages a one-way clutch 62 which in turn engages an output shaft 63. Direction D1 is the locking direction of the one-way clutches and direction D2 is the free-wheeling direction of the clutches. The power stroke of pistons 1 of each plunger moves in direction D3 and the returning upstroke of pistons 1 moves in direction D4. During the power stroke of the lower plunger lower clutch 62 locks and transmits torque to lower output shaft 63. During the power stroke of the upper plunger the upper clutch locks and transmits torque to the upper output shaft. During the power pistons' returning upstrokes, their corresponding own-way clutches unlock and allow their pinion gears to freewheel in direction D2.

Figure 3:
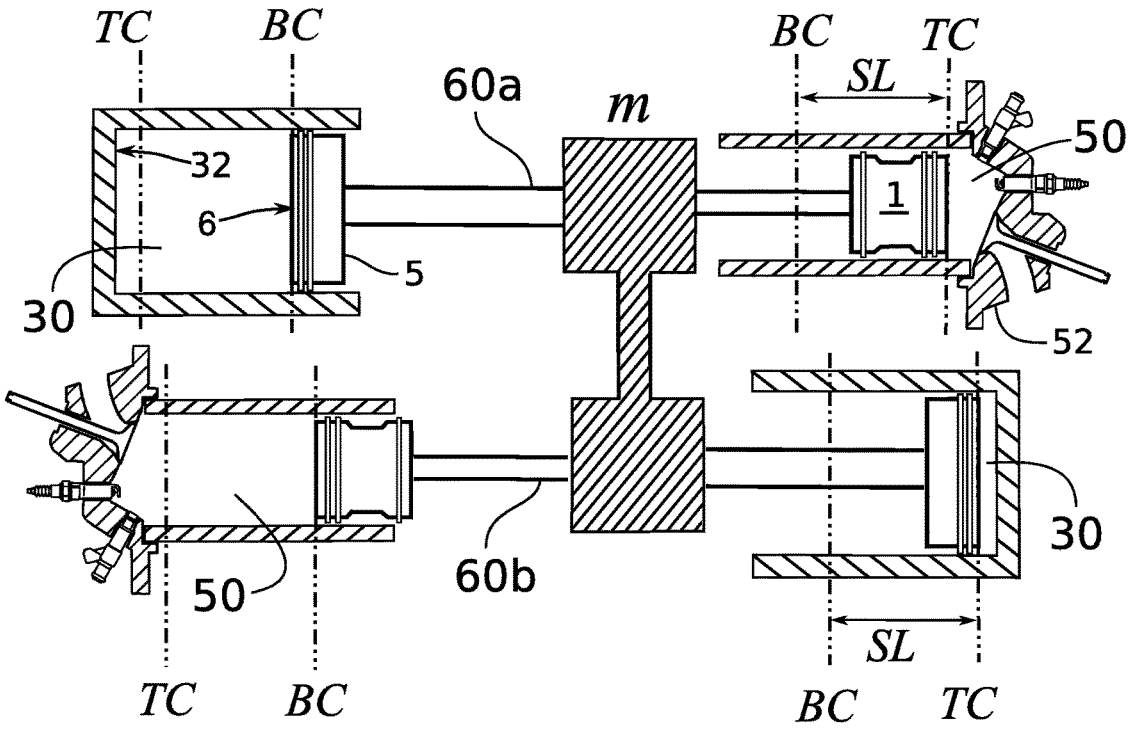
FIG. 3 is a longitudinal diagram of a theoretical free-piston engine for demonstrating the reciprocating dynamics of the current invention.
Figure 4:
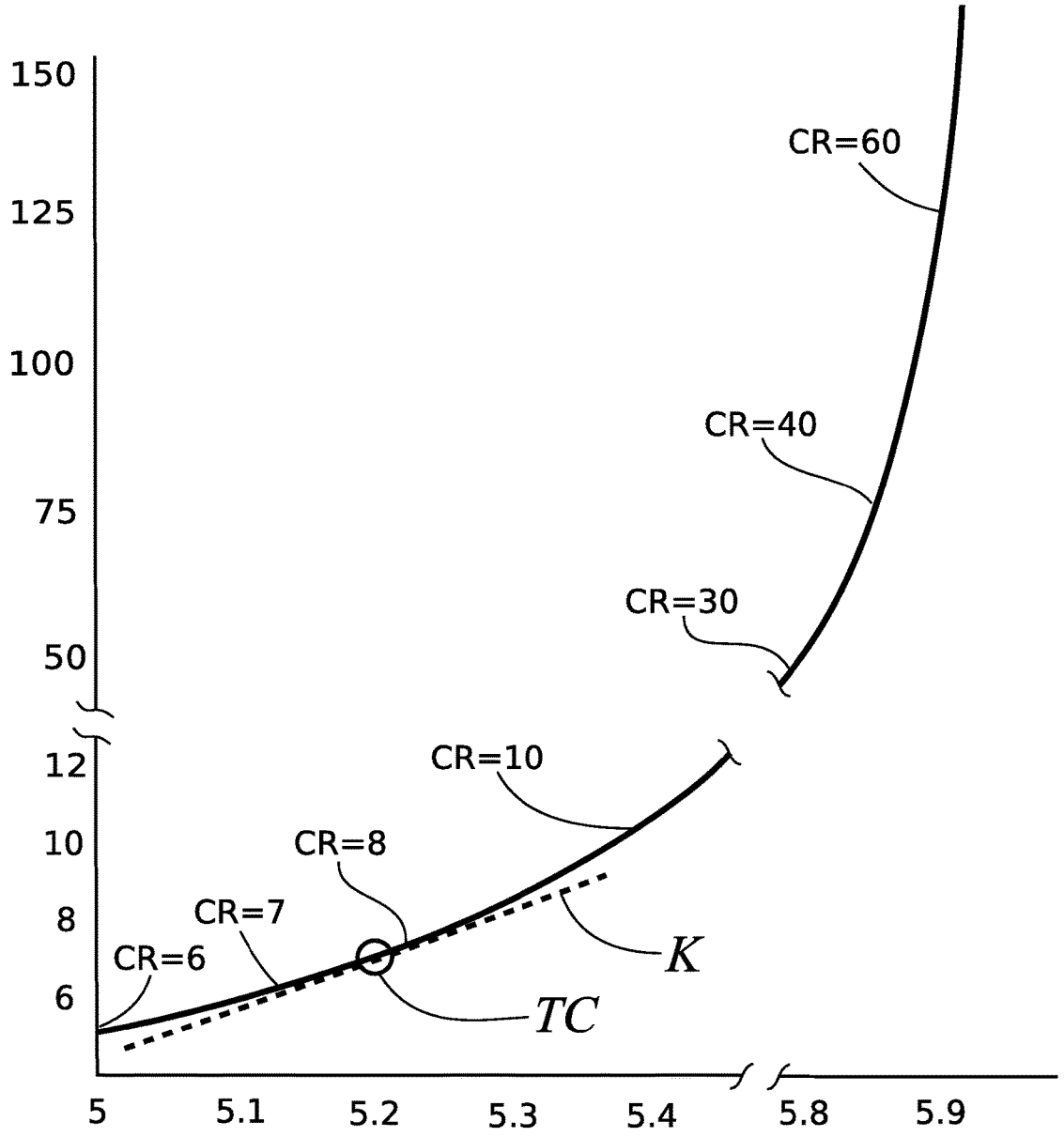
FIG. 4 is a graph of force versus piston displacement in an air-spring such as a bounce chamber or a combustion chamber.

FIG. 3 shows a simplified, theoretical engine model containing no rotating parts but which illustrates the reciprocating dynamics of the present invention. The simplified model has upper and lower plungers 60*a* and 60*b*. Each plunger has a power piston 1 and a bounce piston 5. The two plungers are rigidly attached so that they form a single reciprocating assembly with combined mass m. Note that the compression stroke of the upper plunger power piston occurs with the compression stroke of the lower plunger bounce piston. Conversely, the compression stroke of the lower plunger power piston occurs with the compression stroke of the upper plunger bounce piston. The model therefore allows for a large diameter bounce piston and a small diameter power piston in a symmetrical configuration. Referring to formula (1), the model's spring constant K and the model's cycle rate can be increased by increasing the bounce piston diameters while keeping a smaller power piston diameter. High cycle rates could be achieved at moderate compression ratios even with moderate power piston diameters and large mass values. But the model in FIG. 4 is severely unbalanced and would suffer serious vibration issues, among other problems.

Referring to FIG. 1, engine 100's upper and lower plungers, 60*a* and 60*b*, reciprocate in a counter-balanced manner that diminishes vibration. Because of the mechanical linkage between the two plungers the compression stroke of upper plunger's power piston 1 occurs with the compression stroke of lower plunger's bounce piston 5. Conversely, the compression stroke of the lower plunger's power piston occurs with the compression stroke of the upper plunger's bounce piston. Thus the dynamics of the present invention parallels the model in FIG. 4. High cycle rates are achievable even for heavy mass plungers by providing relatively large bounce piston diameters. These increased cycle rates are achievable while simultaneously employing moderate compression ratios and moderate power piston diameters.

Referring again to FIG. 1, bounce piston top surfaces 6 and bounce chamber ceilings 32 of engine 100 are both flat. These matching surface shapes cause volume 30 to approach zero as the bounce piston approaches contact with the chamber ceiling. The maximum theoretical "top-center" point of the bounce pistons' outboard travel, marked by line TCm, is determined by the contact point of the bounce pistons and the chamber ceilings. But as motion of the bounce piston approaches line TCm compression ratio, pressure and resisting force rises asymptotically as volume 30 is squeezed to null. This factor prevents bounce piston ceiling strikes during normal engine operation even during moderate overspeed excursions, combustion pre-ignition, detonation or other operating anomalies. Additionally, the mechanical linkage of the upper and lower plungers allows the TCm points for the power pistons to be determined by placement of the bounce cylinders. Combustion heads 52 are placed beyond the TCm line so that complex geometries, such as wedge shaped heads, can be implemented without concern for power piston head-strikes. It is notable that points TCm of the bounce pistons also sets the maximum inboard travel, BCm, of the power pistons. Finally, the mechanical linkage of the upper and lower plungers means that point TCm of the upper bounce piston sets point BCm of the lower bounce piston, and visa-versa.

Figure 5:
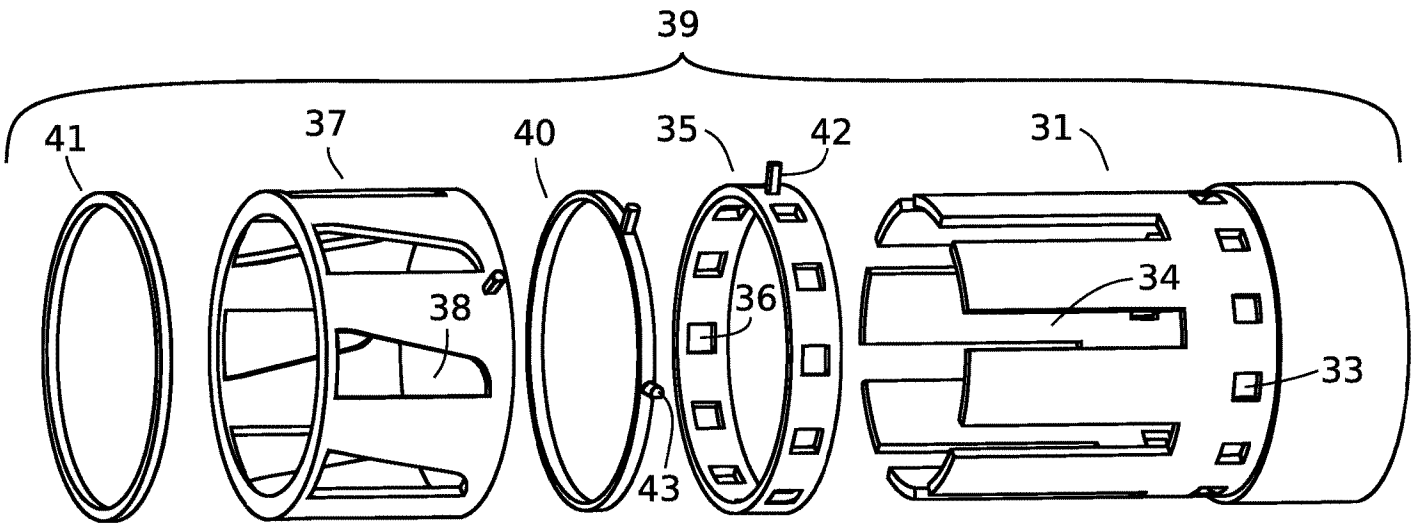
FIG. 5 is an exploded view of bounce assembly 39 of engine 100.

FIG. 5 is an exploded view of bounce assembly 39 of engine 100. Bounce cylinder 31 provide idle ports 33 and power ports 34. Idle sleeve valve 35 fits around the bounce cylinder's idle ports and provides openings 36. Power sleeve valve 37 fits around the bounce cylinder's power ports and provides openings 38. The idle and power sleeve valves are arranged to be slidable about the bounce cylinder in the direction of the cylinder's circumference. Control pegs 42 on each sleeve valve provide an attachment point for the sleeves' positioning mechanisms (not shown). The sleeve's positioning mechanisms may be any appropriate device known in the art operating under control of the engine's Electronic Control Unit (ECU). For example, pneumatic, hydraulic or electrical devices may be employed. Retainer ring 40 fits around the bounce cylinder and is disposed between the idle sleeve valve and power sleeve valve. Ring 40 is rigidly attached to the bounce cylinder and holds the idle sleeve valve in place longitudinally. Retainer ring 41 holds sleeve valve 37 in place longitudinally and is attached to the inboard side of the cylinder. Rings 40 and 41 may be attached to the bounce cylinder by any means known in the art during assembly of the chamber. For example, welds may be used. Anchoring pegs 43 on ring 40 may be provided for anchoring of the sleeve valve's positioning mechanisms, if convenient.

Figure 6:
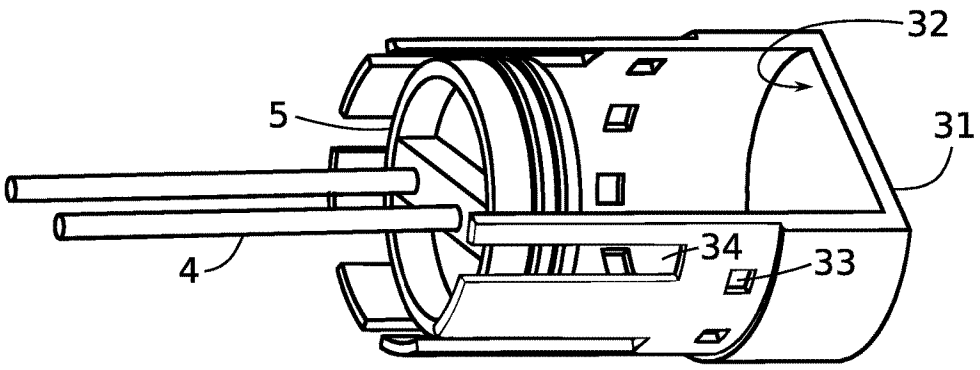
FIG. 6 is a partial section of bounce cylinder 31 shown with bounce piston 5 disposed in an operating position.

FIG. 6 is a perspective view of bounce cylinder 31 with a section broken out. The figure shows bounce piston 5 in position for reciprocating movement within the bounce cylinder. When ports 33 and 34 are open, air is allowed to escape the bounce cylinder during the bounce piston compression stroke until the piston passes ports 33.

Figure 7:
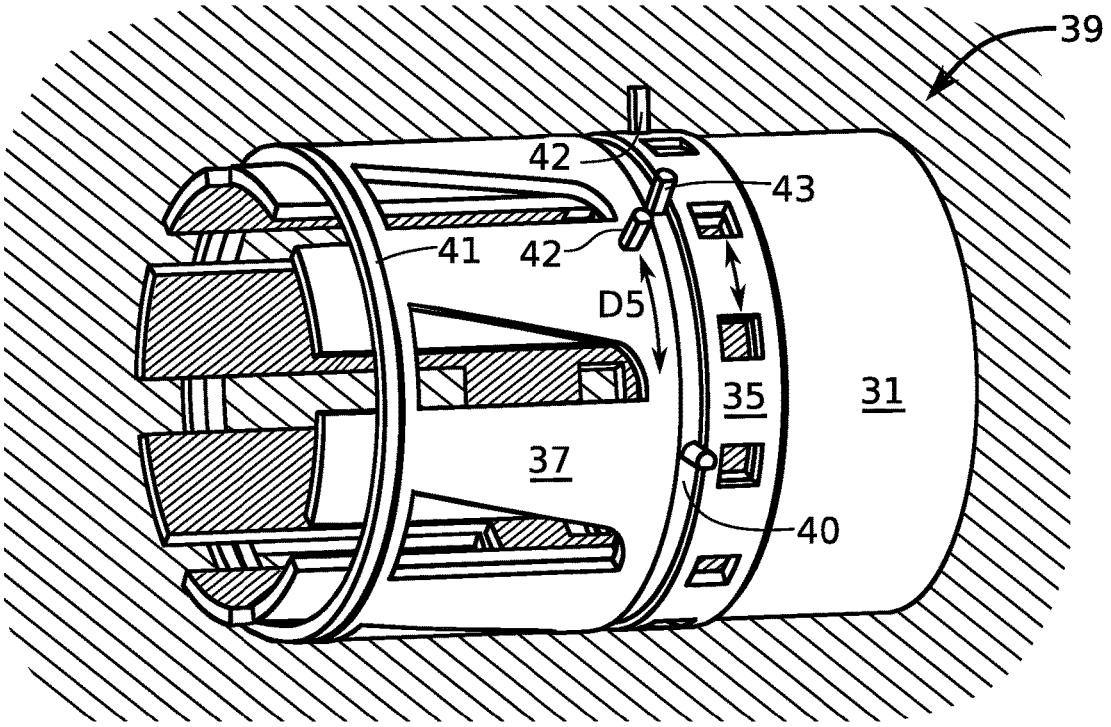
FIG. 7 is a perspective view of bounce assembly 39 of engine 100.

FIG. 7 is a perspective view of the assembled bounce assembly 39. FIG. 7 depicts idle sleeve valve 35 in the fully open position in which the sleeve openings align and unblock the bounce cylinder idle ports. Likewise power sleeve valve 37 is shown in the fully open position with its openings unblocking the bounce cylinder's power ports. Both sleeve valves are slidable about the bounce cylinder circumference in rotational directions D5.

Figure 8:
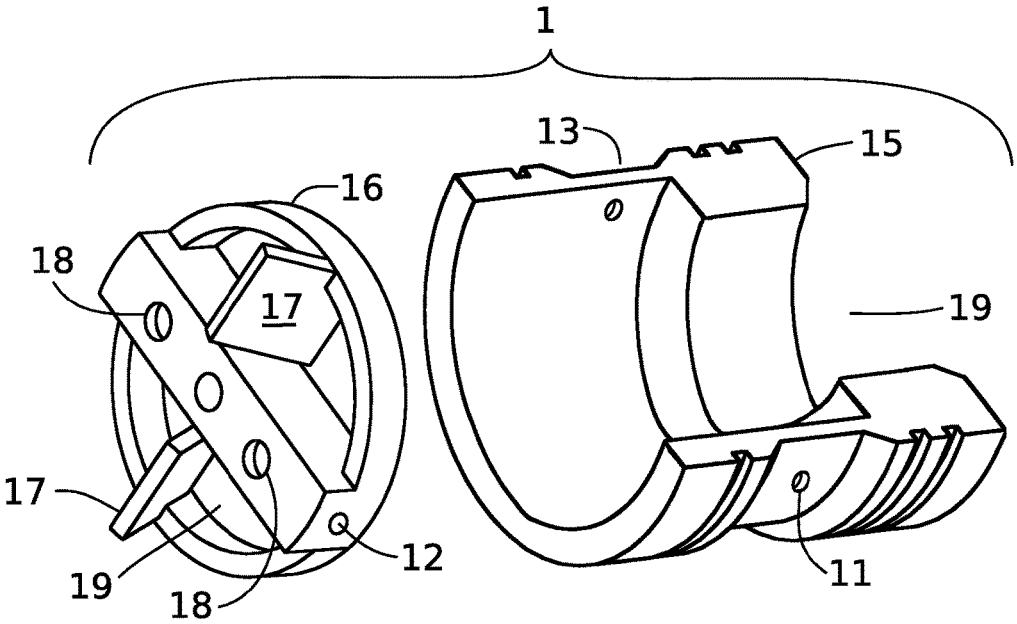
FIG. 8 is an exploded view of power piston 1 shown with a partial section of piston body 15.

FIG. 8 is an exploded view of power piston 1 of engine 100. The piston is comprised of piston body 15 and piston insert 16. The body and insert provide air passage 19 for the flow of scavenging air through the piston. The insert also provides air vanes 17 for introducing rotation in the scavenging air flow. Connecting rod sockets 18, for attachment of connection rods 2, provide oil channels 12 from the sockets to oil outlet 11 to oil cavity 13.

Figure 9A:
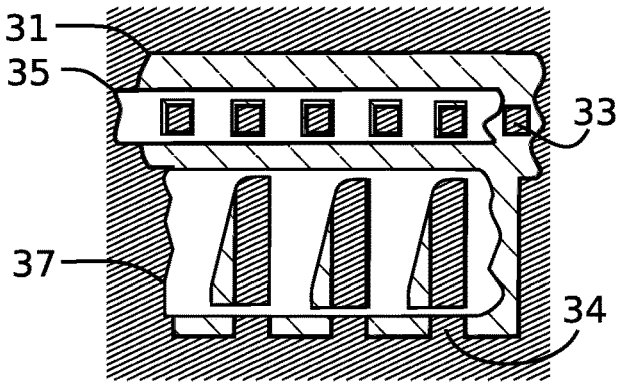
FIG. 9A shows a flattened section of bounce cylinder 31 with the idle and power sleeve valves placed in the fully open position.
Figure 9B:
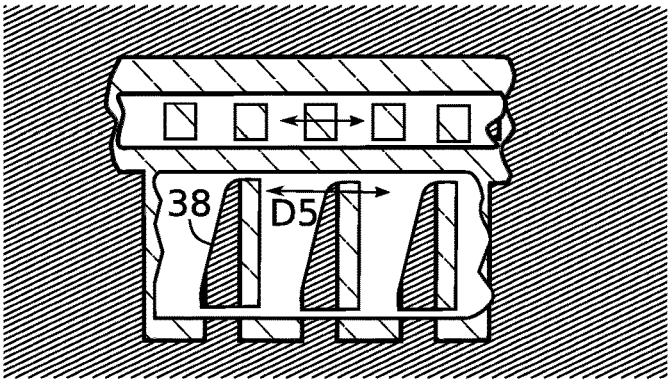
FIG. 9B shows a flattened section of bounce cylinder 31 with the idle sleeve valve fully closed and the power sleeve valve partially closed.

FIG. 9A through FIG. 9B illustrate the operation of sleeve valves 35 and 37 by depicting a flattened section of the sleeves and of cylinder 31. FIG. 9A shows both idle sleeve valve 35 and power sleeve valve 37 in their fully open position. Idle ports 33 power ports 34 of bounce cylinder 31 are unblocked by the sleeve valves. Air escapes through the ports during the bounce piston compression stroke until the piston passes the idle ports. Thus a minimum amount of air is trapped in the cylinder through the completion of the compression stroke and the chamber's spring constant K is at the minimum value. This is the setting provided for engine starting and for low speed idle.

Figure 9C:
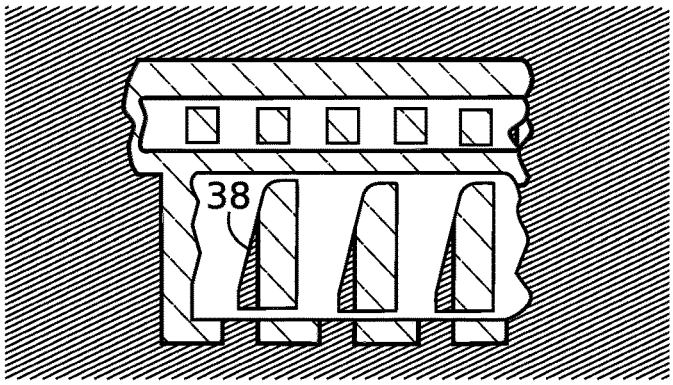
FIG. 9C shows a flattened section of bounce cylinder 31 with the power sleeve valve closed further than shown in FIG. 9B.
Figure 9D:
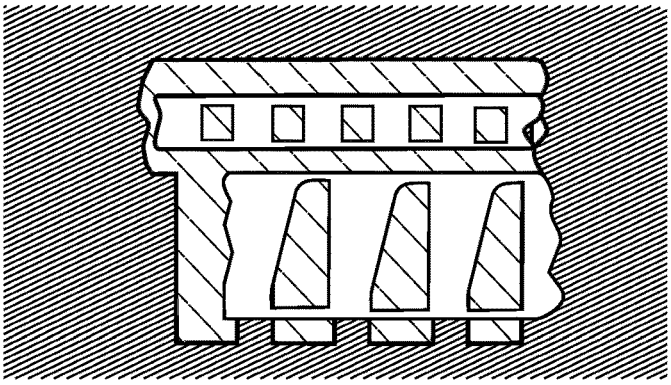
FIG. 9D shows a flattened section of bounce cylinder 31 with both the idle sleeve valve and the power sleeve valve fully closed.

FIG. 9B shows the idle sleeve valve slid into the closed position, blocking the bounce cylinder's idle ports. As the idle sleeve valve is slid in direction D5 toward the closed position the amount of air trapped during the bounce piston's compression stroke is increased. The engine's spring constant K is therefore increased and engine cycle rate is increased. Once the idle sleeve valve is closed engine speed can be increased further by sliding power sleeve valve 37. FIG. 9B depicts the power sleeve valve in a slightly closed position. FIG. 9C shows the power sleeve valve more fully closed than in FIG. 9B. The slanted profile of openings 38 in power sleeve valve 37 provides precise control of the value of spring constant K. Therefore, when the engine is running at any given power level the stroke length SL of the engine is controllable by slight adjustments to the position of sleeve valve 37. FIG. 9D shows the power sleeve valve slid into the fully closed position. This fully closed position sets spring constant K and the engine's cycle rate at the maximum value.

Figure 10:
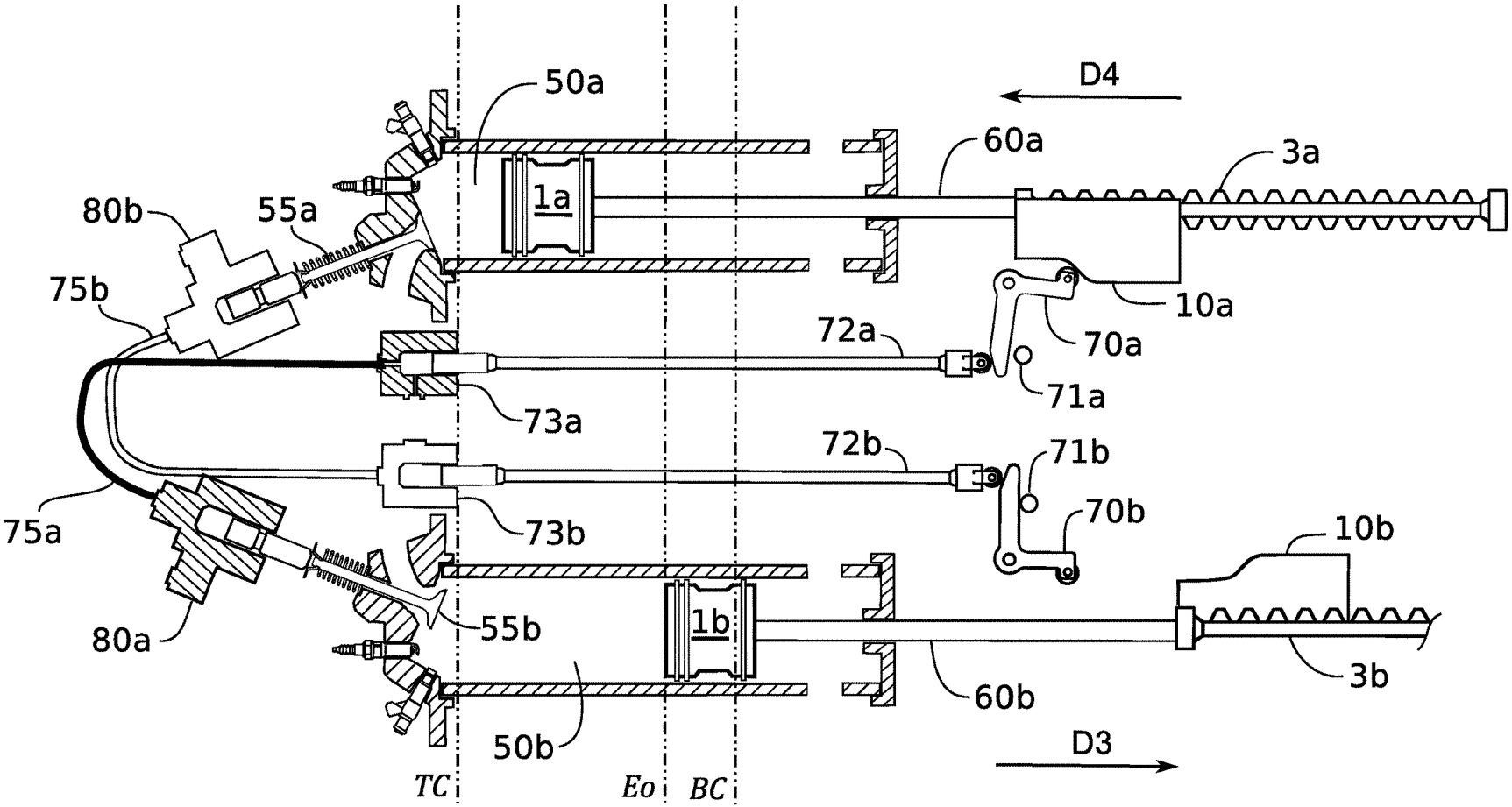
FIG. 10 is a partial longitudinal view of the exhaust valve mechanism of engine 100.

FIG. 10 shows a longitudinal view of engine 100's exhaust valve operating mechanism. During the lower plunger's power stroke, piston 1*b* and rack 3*b* move in direction D3 and upper rack 3*a* moves in direction D4. Upper linear cam 10*a* engages cam rocker 70*a* when piston 1*b* reaches line Eo (i.e. Exhaust open). As the stroke of the plungers continue, linear cam 10*a* forces cam rocker 70*a* to rotate. The cam rocker's rotation forces push rod 72*a*, cam actuator 73*a* and valve actuator 80*a* to open exhaust valve 55*b*. Note that the movement of the upper plunger provides the force to open the lower combustion chamber exhaust valve. Conversely, movement of the lower plunger provides the force to open the upper chamber's exhaust valve 55*a* when upper piston 1*a* reaches point Eo.

Figure 11:
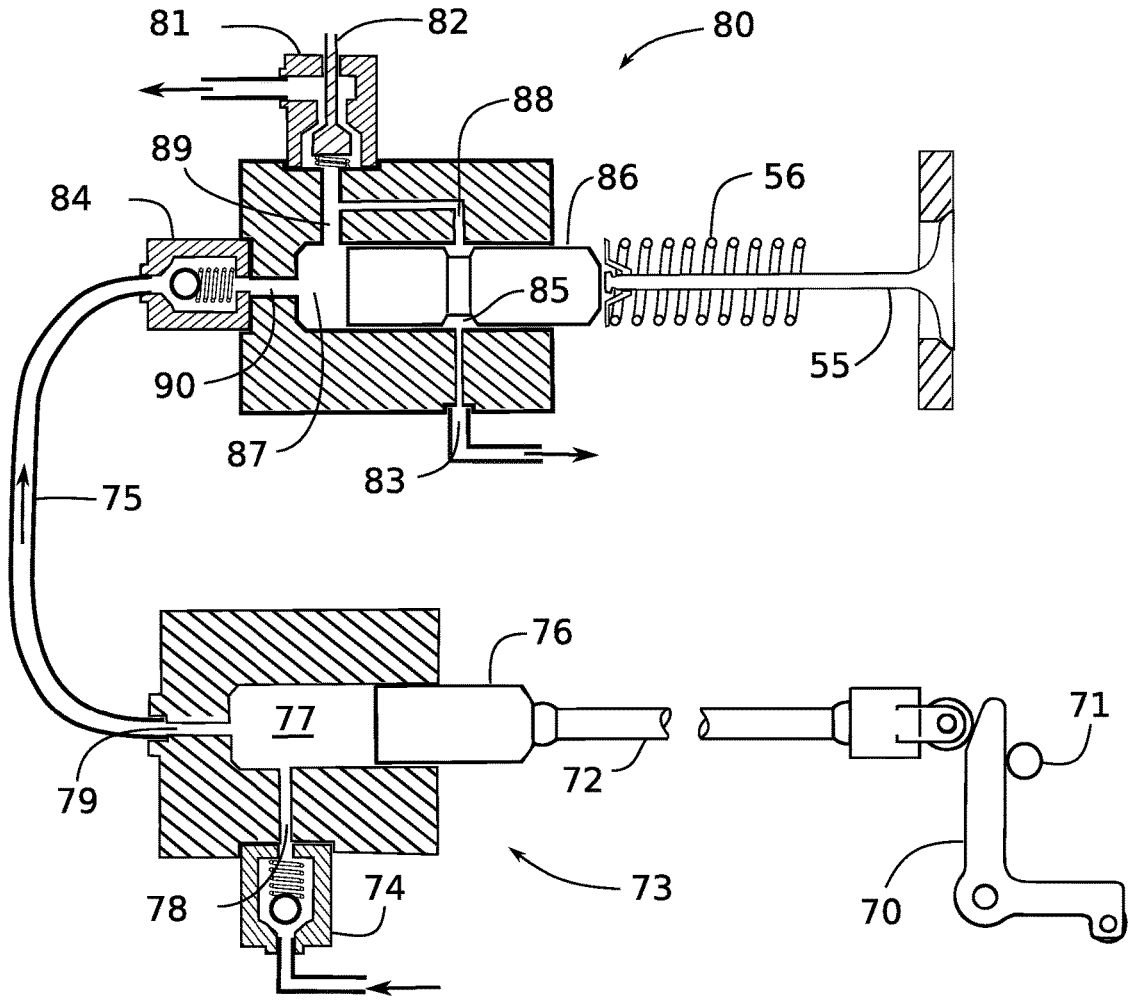
FIG. 11 is a cross sectional view of the mechanical and hydraulic components of the exhaust valve mechanism of engine 100.

FIG. 11 shows a cross-sectional view of the exhaust valve operating mechanism of engine 100. Cam actuator 73 comprises pressure chamber 77, hydraulic piston 76, oil outlet 79, oil inlet 78, and check valve 74. Check valve 74 prevents outflow from oil inlet 78. Valve actuator 80 consists of pressure chamber 87, hydraulic piston 86, oil inlet 90, check valve 84, oil release outlet 89, release valve 81, purge channel 88, and purge outlet 83. Release valve 81 prevents oil outflow from oil release outlet 89 when the release valve is in the closed position. Control plunger 82 of the release valve is operated by a signal from engine 100's electronic control unit (ECU). Operation of the control plunger may be effected by a pneumatic actuator, hydraulic actuator, electric solenoid or any other means known in the art. The release valve's normal position is in the closed position. Piston 86 also provides purge passage 85. Hydraulic line 75 connects the cam actuator oil outlet to the valve actuator's oil inlet through check valve 84. Exhaust valve spring 56 urges piston 86 into its retracted position and urges exhaust valve 55 into the closed position.

The purging process of engine 100's exhaust valve operating system will now be detailed, referrencing FIG. 11. During operation of the engine, oil is supplied to check valve 74 of cam actuator 73 at a pressure level that will be termed the "purging pressure." When valve actuator piston 86 is in its recessed position, purge passage 85 allows oil flow through purge channel 88 to purge outlet 83. The oil flow thus produced takes the following path: into check valve 74, through inlet 78, chamber 77, outlet 79, hydraulic line 75, check valve 84, oil inlet 90, chamber 87, purge channel 88, purge passage 85, purge outlet 83. During the purging process, the path is filled with oil and most or all air trapped in the path is forced out the purge outlet. A second purge outlet is provided when release valve 81 is opened. That is, with the release valve opened, trapped air can also escape out valve 81. A preliminary purging cycle may be employed before engine start-up by momentarily opening release valve 81 while the oil supply is brought up to pressure. As the system reaches the purging pressure piston 76 is urged into its extended position and push rod 72 turns cam rocker 70 until the rocker is pressed against rocker stop 71. The purging pressure level is not high enough, however, to compress valve spring 56 and exhaust valve 55 remains closed.

Figure 12:
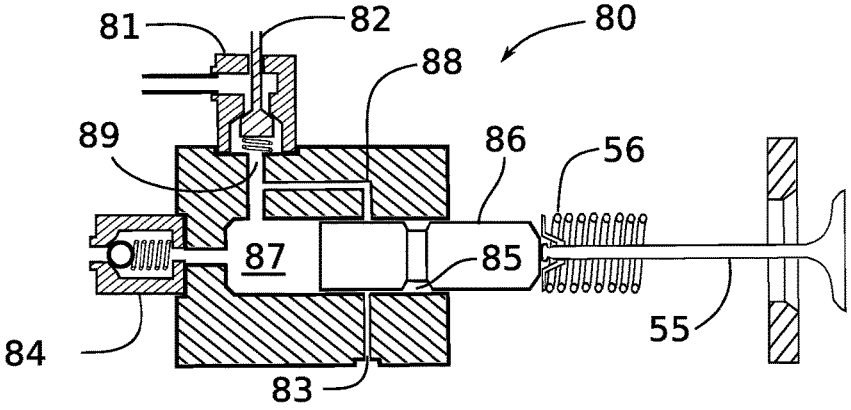
FIG. 12 is a cross sectional view of the hydraulic valve actuator of engine 100. The valve actuator is depicted in its locking position.

The operation of engine 100's exhaust valves will now be detailed in reference to FIG. 11. During operation of the engine the reciprocating motion of the engine's plungers cause the plunger linear cams to alternately engage and disengage rocker arms 70. When rocker arm 70 is rotated by action of its plunger's linear cam, push rod 72 forces cam actuator piston 72 into the chamber 77. The hydraulic force generated forces check valve 74 closed, and the pressure is transmitted through hydraulic line 75. The pressurized hydraulic flow forces valve actuator piston 86 to extend and to open exhaust valve 55. The pressure in chambers 77 and 87, when opening the exhaust valve as described, is produced by the reactive force of compressing valve spring 56. This opening pressure is higher than the purging oil pressure. As valve actuator piston 86 extends purge channel 88 is closed as shown in FIG. 12.

Referring again to FIG. 11, after the exhaust valve is opened by the rotation of cam rocker 70, the linear cam will release the rocker when the plunger's stroke reverses and proceeds with the opposite chamber's power stroke. The pressure in chamber 77 drops to the purging pressure level at inlet 78 when the cam rocker is released. Oil flow at inlet 78 at the purging pressure forces piston 76, push rod 72 and rocker arm 70 back until rocker stop 71 is contacted. FIG. 12 shows valve actuator 80 in its holding state. When the cam rocker arm is released the pressure drops to the purging pressure in line 75 and check valve 84 closes. The pressure in chamber 87 remains high and the valve actuator continues to hold exhaust valve 55 open. (Leakage may eventually allow the exhaust valve to close, but not within the time period of an engine cycle.) Piston 86 and exhaust valve 55 are allowed to return to the closed position when the engine's ECU commands release valve 81 open.

Figure 13:
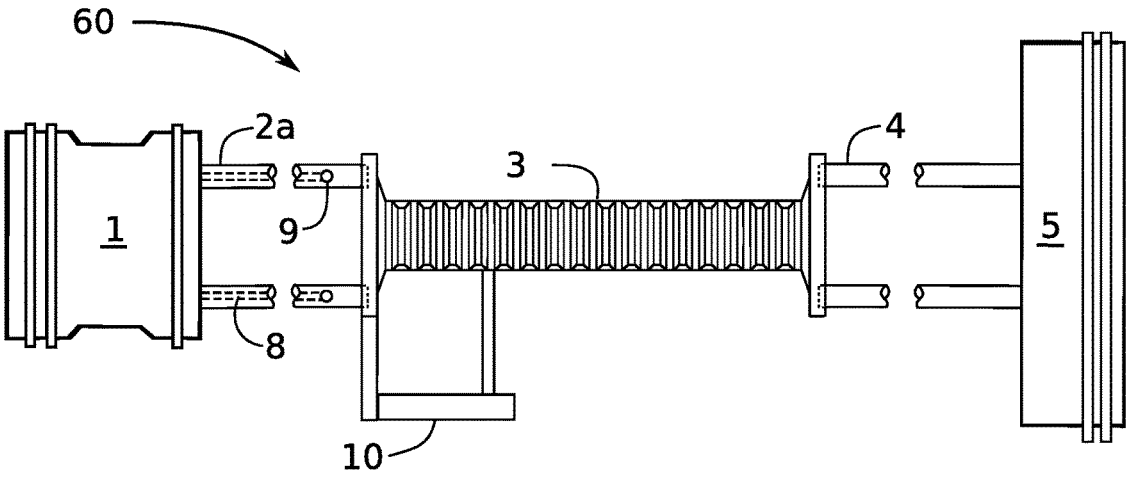
FIG. 13 is a top view of plunger assembly 60 of engine 100.

FIG. 13 is a top-view of plunger assembly 60 of engine 100. Connecting rods 4 attach bounce piston 5 to gear rack 3 and connecting rods 2*a* attach power piston 1 to the rack. Oil channels 8 in connecting rods 2*a* lead to oil outlets 9 outside the combustion chamber. The function of the connecting rod oil channels and oil outlets will be detailed later in the disclosure. Linear cam 10 is attached to rack 3 on the power piston side of the rack.

Figure 14:
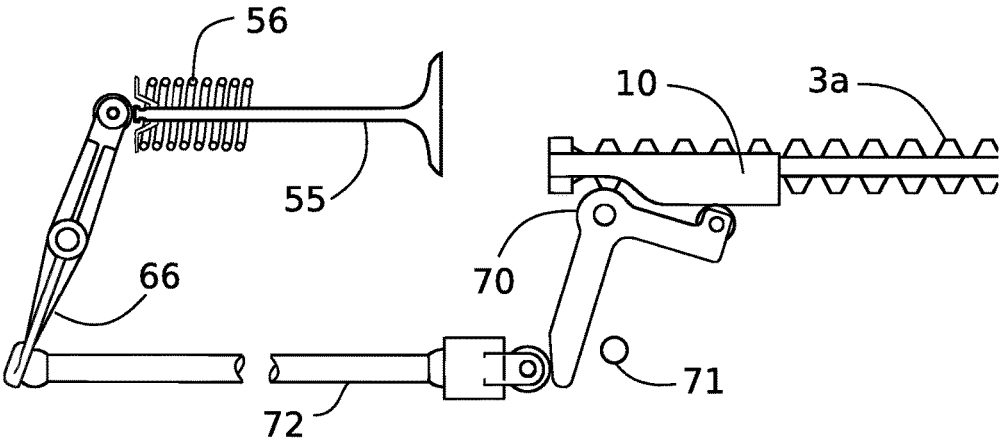
FIG. 14 is a longitudinal view of an alternative mechanism for operation of a gas valve for the current invention.

FIG. 14 is a side view of an alternative embodiment of the present invention's exhaust valve operating mechanism. This embodiment of the mechanism may be useful in engines that do not require variable valve timing. Push rod 72 is operated by linear cam 10 and cam rocker 70 as already described. The outboard end of push rod 72 engages valve rocker arm 66. Operation of valve rocker 66 opens and closes exhaust valve 55.

Figure 15:
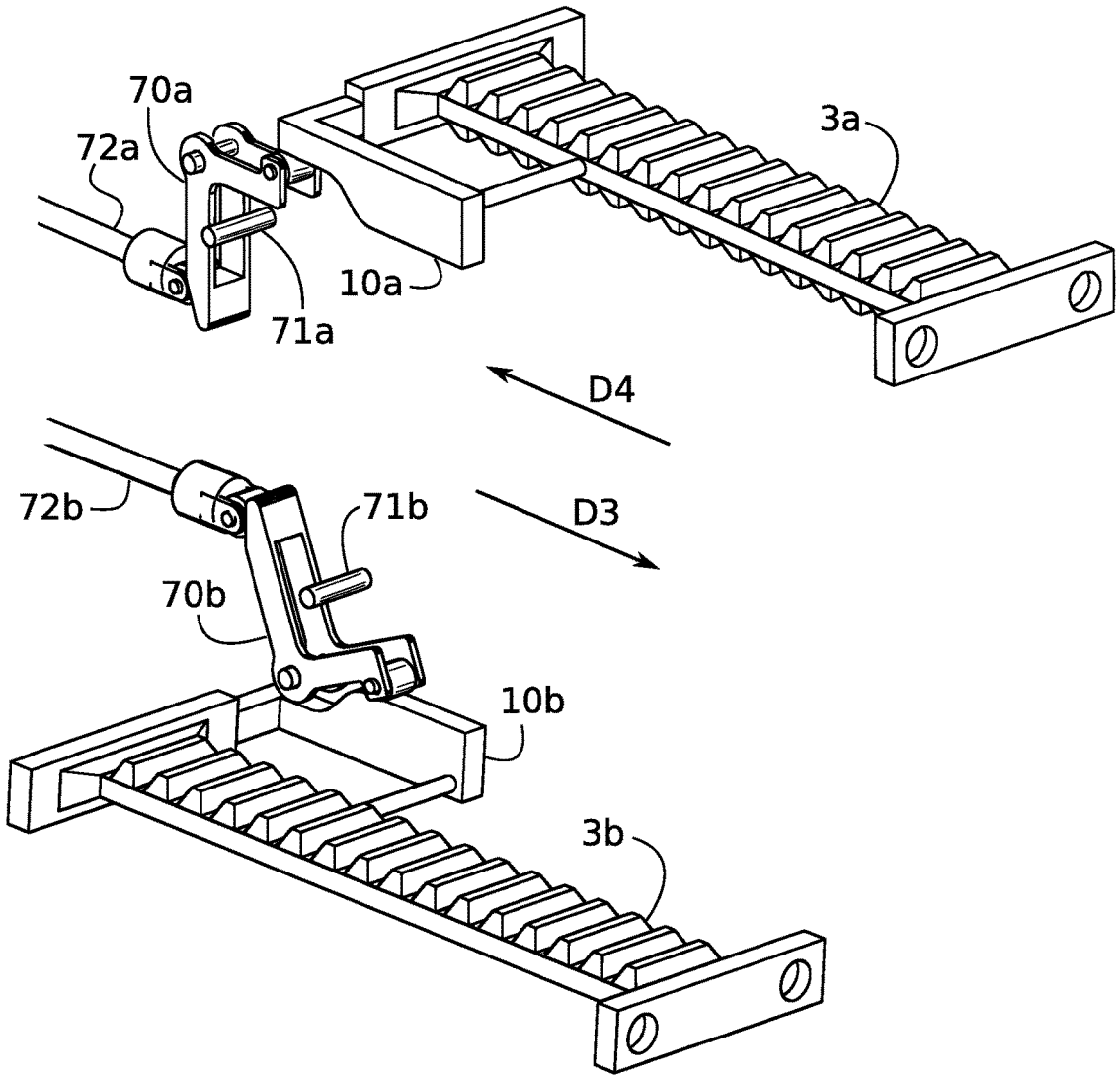
FIG. 15 is a perspective view of the linear cams and cam rockers of engine 100.

FIG. 15 is a perspective view of engine 100's gear racks, linear cams and cam rocker mechanisms. In the figure push rod 72*a* is shown in the closed position and push rod 72*b* is shown in the open position. As upper plunger rack 3*a* moves in direction D4 from the position illustrated cam 10*a* engages rocker arm 70*a*, the rocker arm is rotated, and push rod 72*a* is forced to move in direction D4. As lower plunger rack 3*b* moves in direction D3 from the position illustrated cam 10*b* disengages from rocker arm 70*b*, push rod 72*b* is allowed to make its returning motion in direction D3, and rocker arm 70*b* rotates back until it rests against rocker stop 71*b*.

Figure 16:
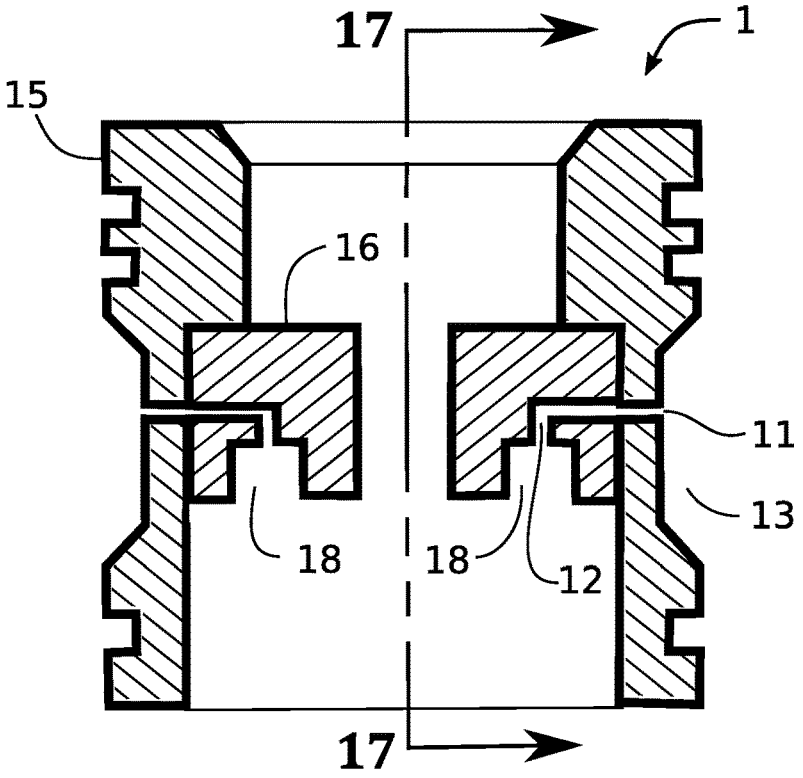
FIG. 16 is a cross sectional view of piston 1 of engine 100.
Figure 17:
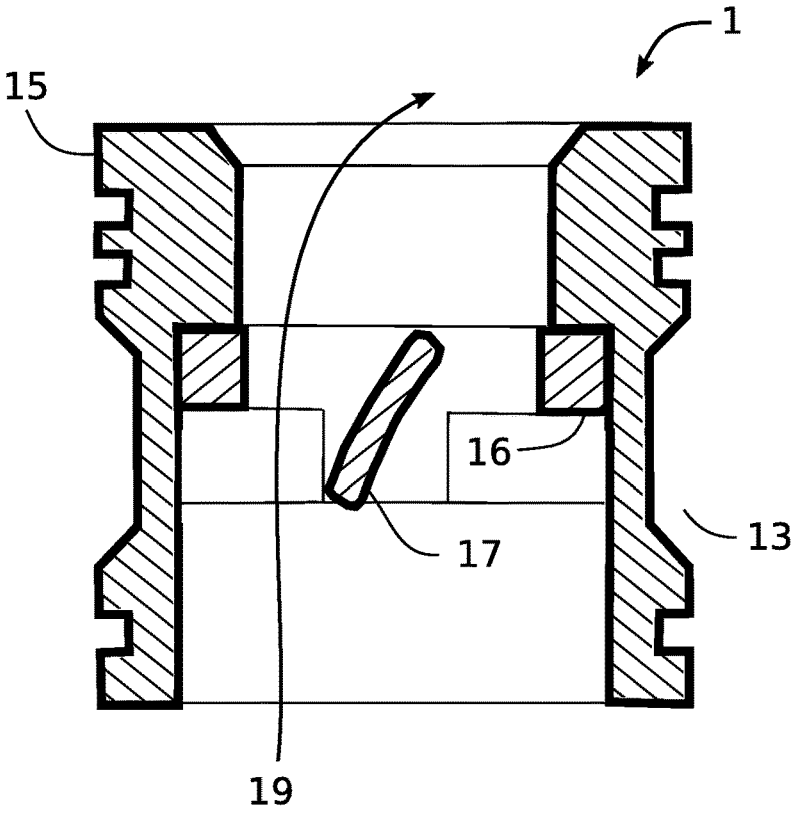
FIG. 17 is a cross sectional view of piston 1 taken along line 17-17 of FIG. 16.

FIG. 16 is a longitudinal cross-section of power piston 1 of engine 100 and shows piston insert 16 installed in piston body 15. Oil channel 12 provides a path for lubricating oil to flow between oil cavity 13 and connecting rod sockets 18. FIG. 17 is a cross-section taken along line 17-17 of FIG. 16. Air vane 17 introduces rotation to the air flow passing through air passage 19 from the piston bottom to the piston top.

Referring to FIG. 1 a portion of engine 100's scavenging system will now be detailed. Pumping head 59 covers the inboard side of power cylinder 51 to form pumping chamber 58 between the pumping head and power piston 1. Intake reservoir case 46 surrounds cylinder 51 toward the inboard side of the cylinder to form intake cavity 47. Intake check valve 45, a reed valve, is a one-way valve that allows air flow into the intake cavity. Intake ports 49 in cylinder 51 allow air passage between the intake cavity and pumping chamber. Pumping head 59 allows sealed linear movement of connecting rods 2 in directions D3 and D4 through the pumping head. Intake cavity 47 and pumping chamber 58 together form a sealed air reservoir that will be termed the scavenging reservoir.

Figure 18:
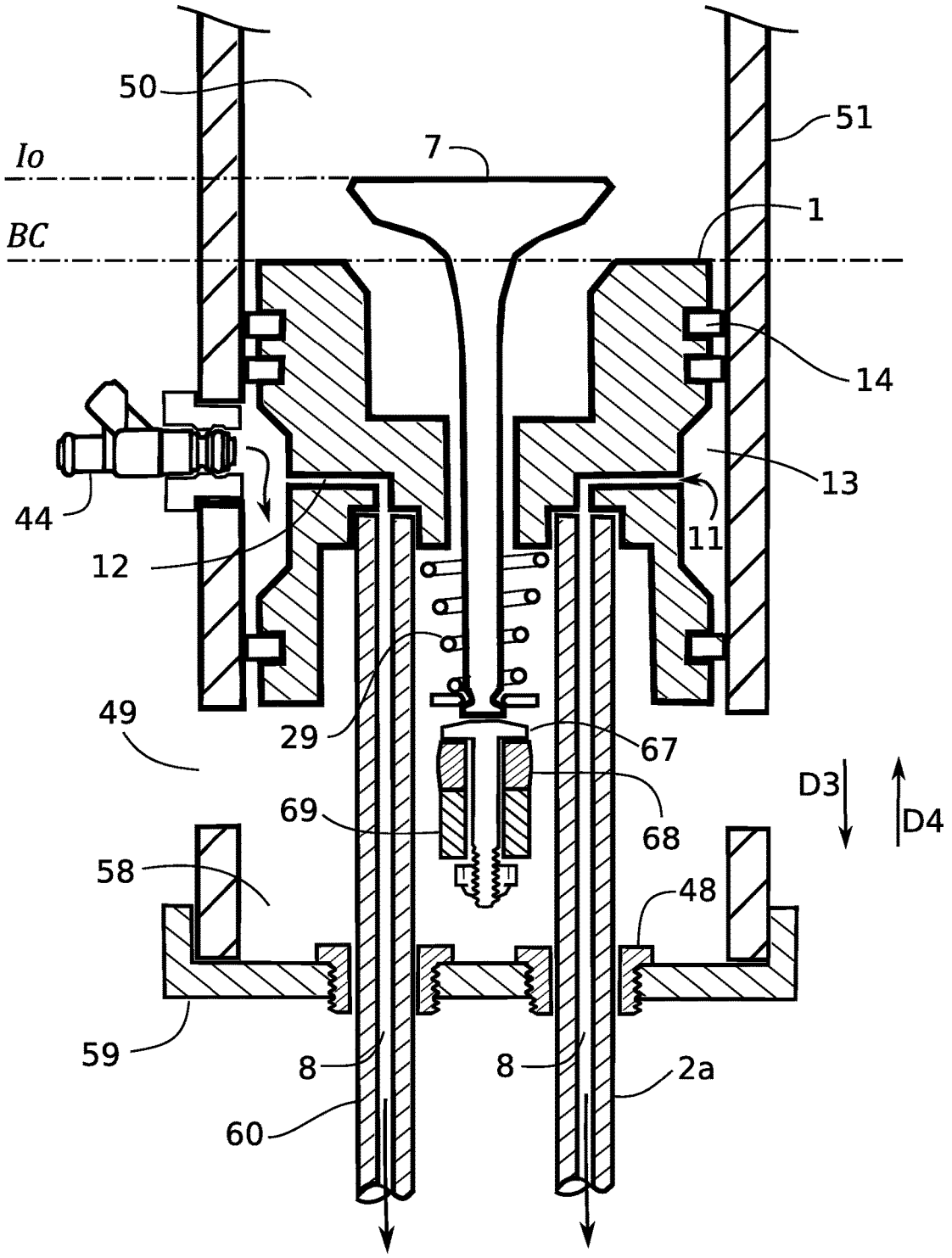
FIG. 18 is a cross sectional view of the inboard portion of combustion cylinder 51 with piston 1 of plunger 60 situated at a bottom-center point (BC).

FIG. 18 is a longitudinal cross-section of the inboard side of combustion cylinder 51 and a partial section of the plunger assembly 60. Piston 1 is shown with piston body 15 and insert 26, shown in FIG. 8, merged into a single piece. Oil cavity 13 holds a reservoir of oil for lubrication of the piston's motion through cylinder 51. The piston is shown at the bottom-center of its downstroke, marked by line BC. Leakage of the lubricating oil into combustion chamber 50 is prevented by the outboard piston rings 14, and leakage of oil into pumping chamber 58 is prevented by the inboard piston rings. Pumping head 59 seals the inboard side of cylinder 51. Connecting rods 2*a* are attached to piston 1 and provide oil channels 8 from oil cavity 13 to the outside of the cylinder. Oil injector 44 accesses the inside of cylinder 51 through a sealed port and is arranged so that the injector does not interfere with motion of the piston. Rod seals 48 allow low friction and sealed reciprocating movement of connecting rods 2*a* through the pumping head. Intake valve 7 resides in piston 1 and is urged toward the closed position by valve spring 29. This placement of a poppet valve and air passage inside an internal combustion piston has been termed a "pop-top valve" arrangement. Valve stop 67 is held in place by stop support 69 and stop rubber 68.

In reference to FIG. 18 the operation of intake valve 7 and of oil injector 44 will now be detailed. During the piston's downstroke and as the piston approaches BC in direction D3, valve stop 67 halts the inboard movement of intake valve 7 at mark Io, the intake valve opening point. With the intake valve open, compressed air held in the scavenging reservoir is allowed to pass through port 49 and through piston 1 into combustion chamber 50. Stop rubber 68 is comprised of an elastic material so as to flex with the impact of the intake valve. Engine 100's Electronic Control Unit signals the injector to operate when the oil cavity is aligned with the injector. Outflow of oil from the cavity passes through oil outlet 11, through piston passage 12, through rod channels 8, and out of the combustion cylinder.

Figure 19:
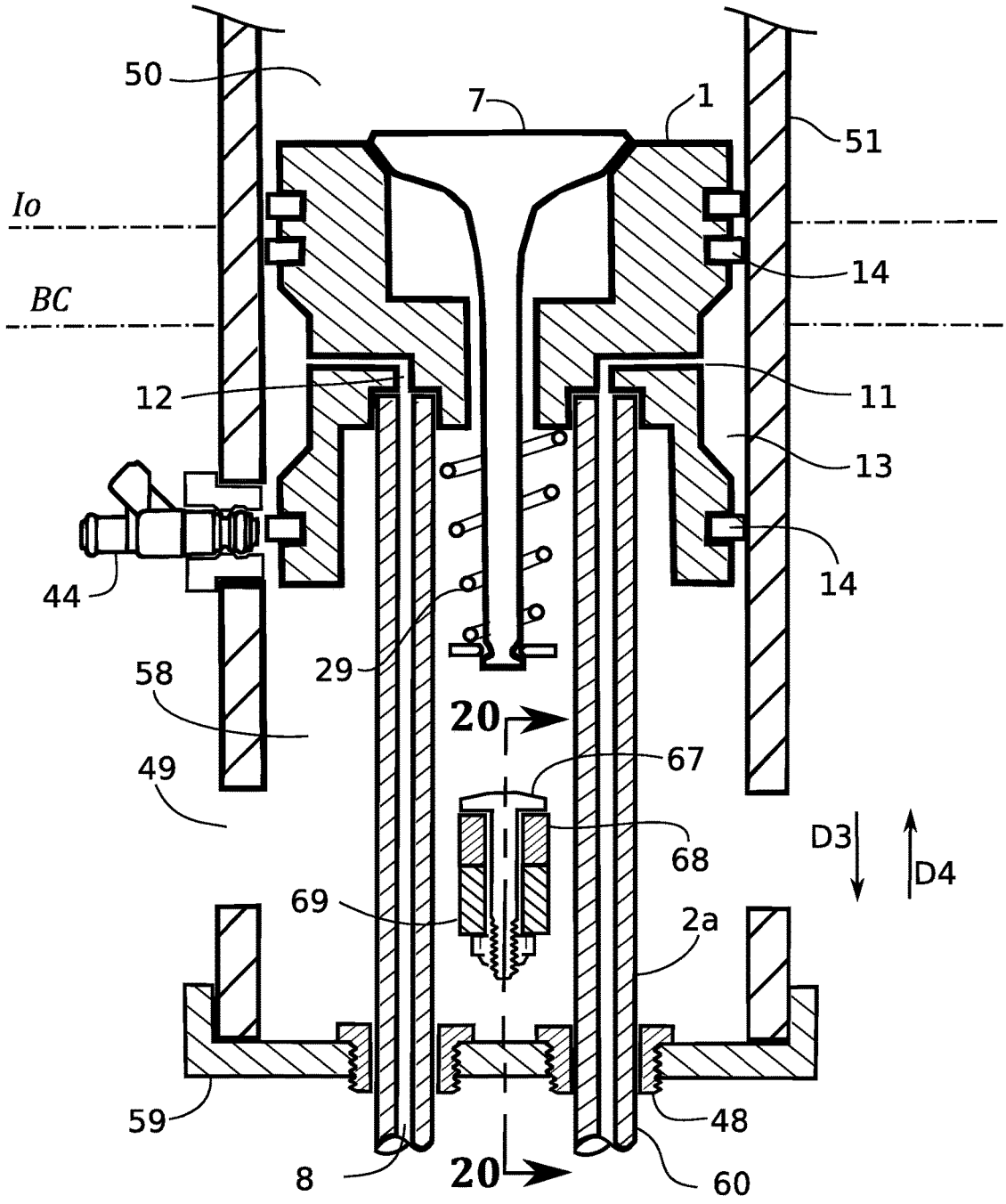
FIG. 19 is a cross sectional view of the inboard portion of combustion cylinder 51 with piston 1 of plunger 60 situated outboard of point Io (intake valve open).

FIG. 19 is also a longitudinal cross-section of the inboard side of combustion cylinder 51 and a partial section of the plunger assembly 60. In FIG. 19 the plunger assembly is shown in a position outboard of points BC and Io. Inertial force, gas pressure in chamber 51 and the force of spring 29 combine to close intake valve 7.

Figure 20:
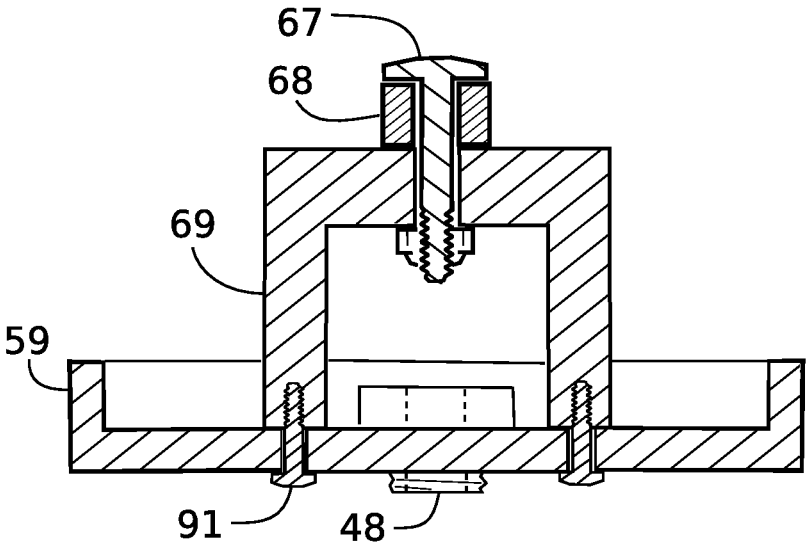
FIG. 20 is a cross sectional view of pumping head 59, the section taken along line 20-20 of FIG. 19.
Figure 21:
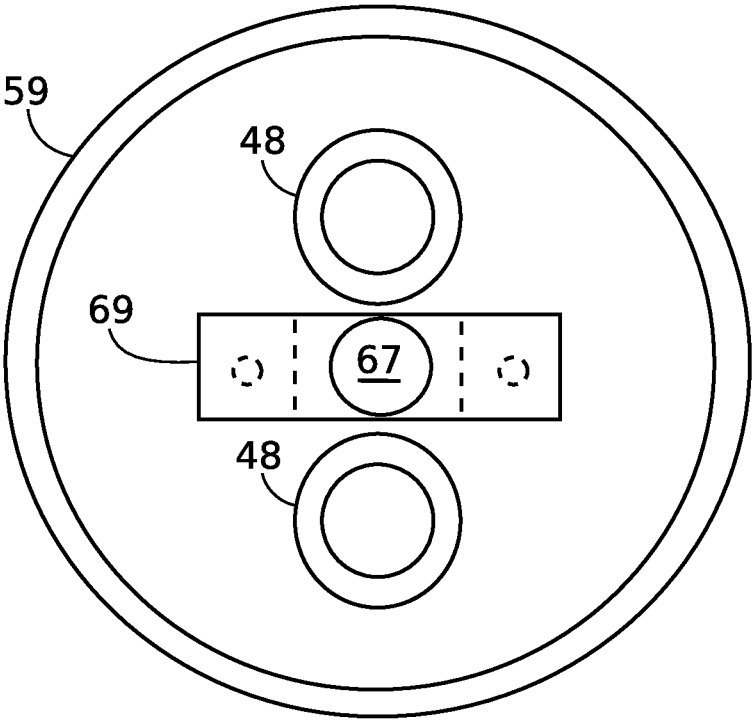
FIG. 21 is a top view of pumping head 59.

FIG. 20 is the cross-section of engine 100's pumping head and intake valve stop, taken along line 20-20 of FIG. 19. Valve stop support 69 may be attached to pumping head 59 by any means known in the art, for example with screws 91. FIG. 21 is a top-side view of the assembly comprising pumping head 59, connection rod seals 48, valve stop support 69 and valve stop 67. The assembly seals the inboard end of combustion cylinder 1 while allowing piston rods 7 to have sealed linear movement.

Figure 22A:
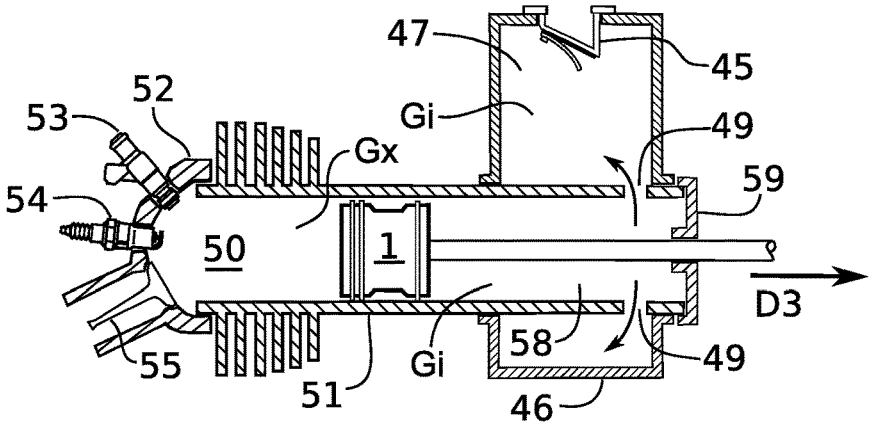
FIG. 22A shows the gas exchange process in engine 100 with piston 1 passing midway of its downstroke.
Figure 22B:
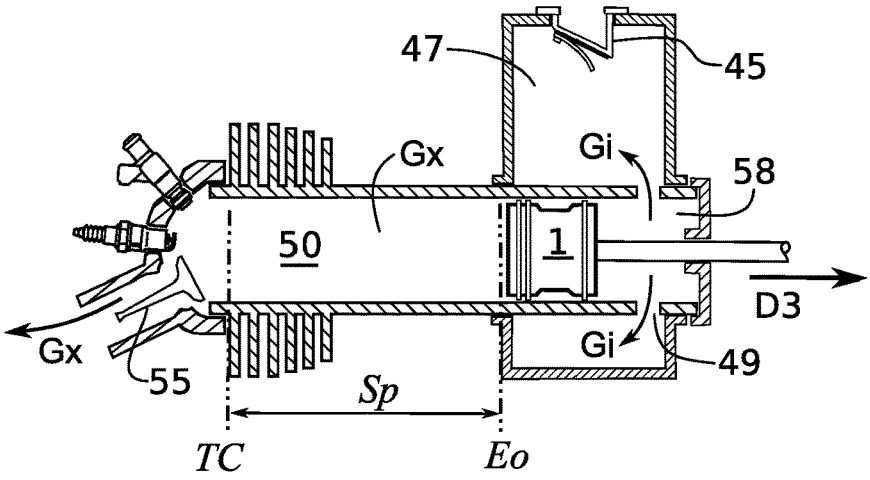
FIG. 22B shows the gas exchange process in engine 100 with piston 1 passing point Eo of its downstroke.
Figure 22C:
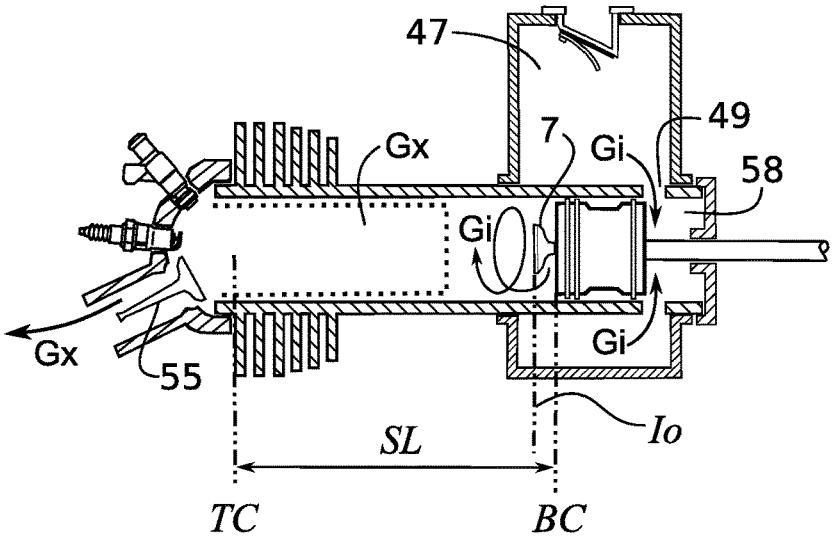
FIG. 22C shows the gas exchange process in engine 100 with piston 1 reaching bottom-center (BC) of its downstroke.

FIG. 22A through FIG. 23C are diagrams of various stages of engine 100's engine cycle. FIG. 22A shows power piston 1 at a mid-point in its power stroke. The pressure of combusting fuel mixture Gx in combustion chamber 50 contributes to the piston's downstroke in direction D3. Scavenging air Gi in pumping chamber 58 is forced by the piston's motion through ports 49 into intake cavity 47. Reed valve 45 prevents gas Gi from escaping and the air mass in the scavenging reservoir is compressed. FIG. 22B shows the power piston as it reaches point Eo, (Exhaust Open), in the downstroke. At this point exhaust valve 55 begins to open and combusted fuel mixture Gx starts to evacuate the combustion chamber through the exhaust port. The plunger continues its downstroke in the D3 direction but the stroke stops producing much power from gas pressure in chamber 50 because the exhaust valve has opened. Therefore, the length of the downstroke from TC to Eo will be described as the piston's power stroke, Sp. FIG. 22C shows the power piston at bottom-center BC, where the piston motion halts and reverses direction. Line Io marks the point of the downstroke at which intake valve 7 opens. It should be noted that, depending on various design parameters, point Eo may or may not precede point Io in the engine cycle. After the intake valve opens, pressurized air Gi enters the combustion chamber from the scavenging reservoir through the power piston. Rotation is introduced into the fresh air flow from its passage through the piston's air passage. The fresh air flow into the combustion chamber pushes exhaust gas Gx out the exhaust port in a uniflow scavenging process.

Figure 23A:
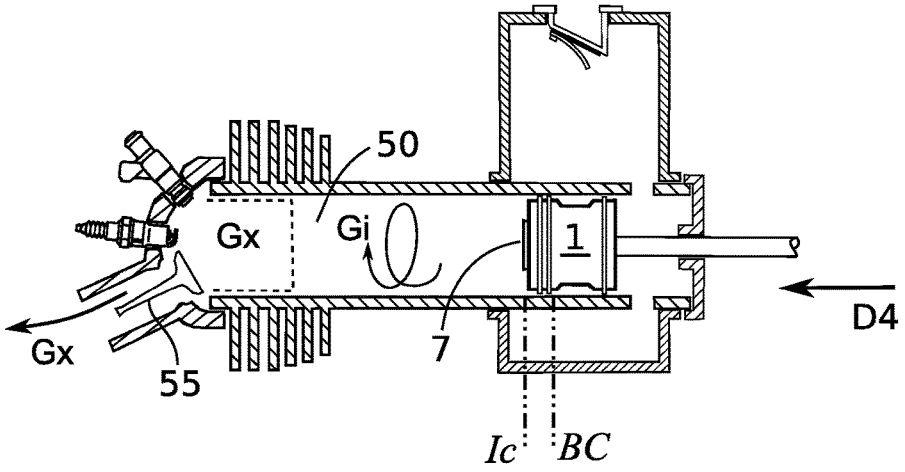
FIG. 23A shows the gas exchange process in engine 100 with piston 1 passing point Io of its upstroke.
Figure 23B:
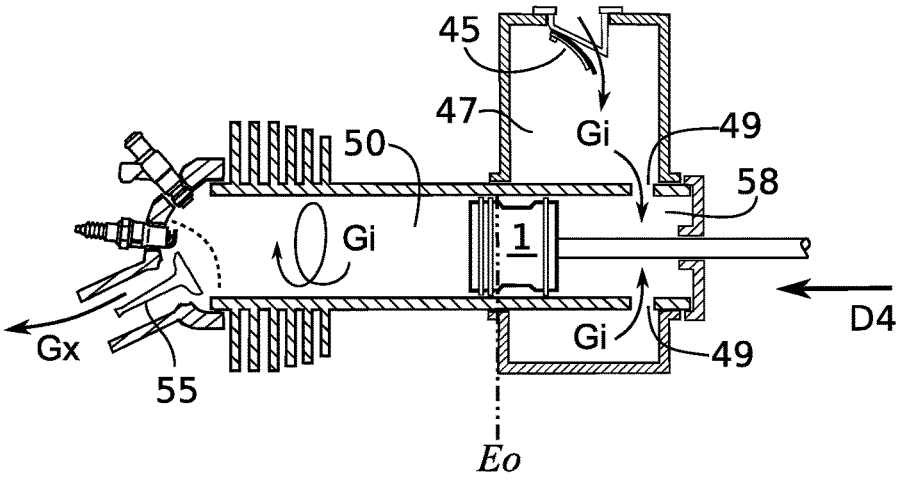
FIG. 23B shows the gas exchange process in engine 100 with piston 1 passing point Eo of its upstroke.
Figure 23C:
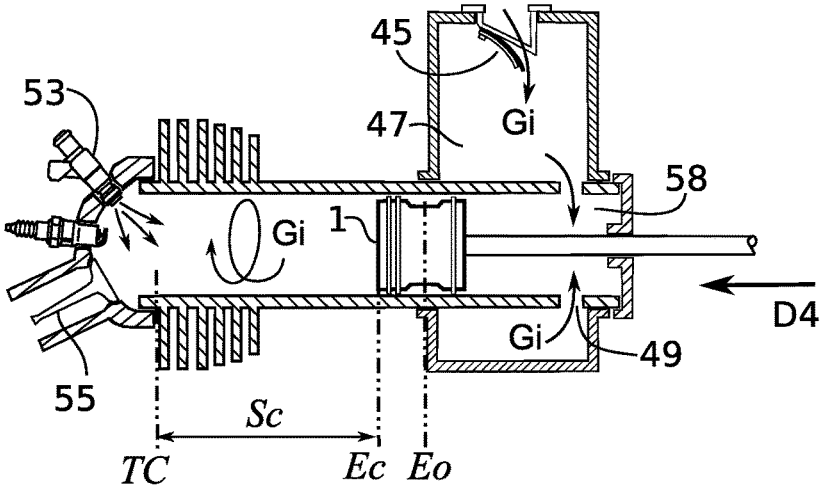
FIG. 23C shows the gas exchange process in engine 100 with piston 1 passing point Ec of its upstroke.

FIG. 23A through FIG. 23C diagram the various stages of engine 100's engine cycle during the power piston's upstroke. In FIG. 23A the power piston 1 is moving in direction D4 from bottom-center BC to the point where intake valve 7 closes, Ic. (Ic occurs at the same point as Io.) Exhaust products Gx may not have completely evacuated from the combustion chamber 50 at this stage. Rotation of Gi tends to contain the intake air toward the inboard side of the combustion chamber and tends to segregate the remaining exhaust products toward the outboard side of the cylinder. FIG. 23B shows the power piston continuing the upstroke past point Eo, the point at which the exhaust valve opened on the downstroke. The exhaust valve operating mechanism allows exhaust valve 55 to remain open past point Eo on the upstroke. The piston upstroke forces continued evacuation of gas from chamber 50 through the exhaust port. Because remaining exhaust products Gx tend to concentrate toward the outboard side of the chamber the continuing upstroke can lead to nearly complete evacuation of the exhaust products. A new charge of air, Gi, is drawn into the scavenging reservoir through intake check valve 45 as the upstroke continues.

FIG. 23C shows the power piston continuing its upstroke from point Eo to Ec, the point at which exhaust valve 55 closes. The subsequent continuation of the upstroke from point Ec to TC constitutes the compression stroke Sc. During the compression stroke injector 53 may perform fuel injection under control of the engine's ECU. The compression stroke continues to pull air Gi into the scavenging reservoir. The ECU can time the exhaust valve closing point Ec to occur inboard of Ec, thus making power stroke SP longer than compression stroke Sc. This method implements an extended power stroke, also known as an Atkinson cycle. An extended power stroke is known to significantly improve the thermodynamic efficiency of the engine cycle. The ratio of power stroke to compression stroke length is controllable by the ECU by timing of the control signal operating the valve actuator release plunger 82 (see FIGS. 11 and 12).

Figure 24:
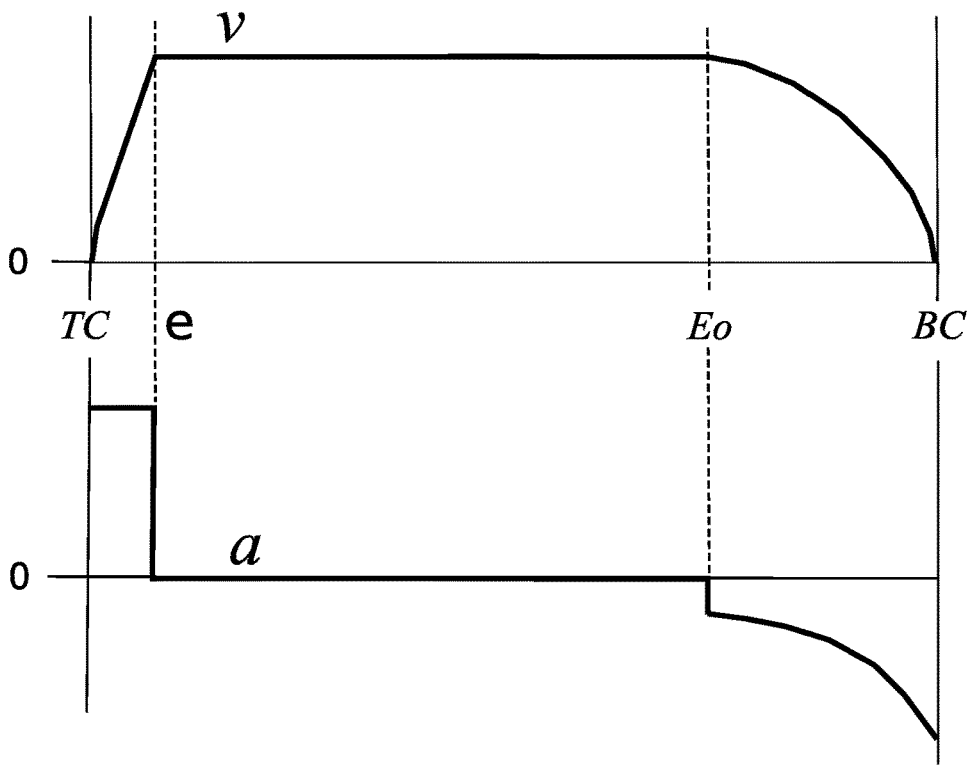
FIG. 24 shows graphs of the velocity (v) and acceleration (a) versus displacement of the engine 100 power pistons during the piston downstroke.

FIG. 24 shows graphs of the velocity and acceleration of engine 100's power pistons on its downstroke from top-center TC to bottom-center BC. The graph's horizontal axes show longitudinal piston displacement. The graphs depict operation of the engine under load and at or near full power. The top graph shows the piston's velocity v increasing rapidly from zero to its maximum value. Point e marks the point in the downstroke where one-way clutch 62 engages and locks the motion of the plunger to the rotation of output shaft 63. The piston downstroke continues at constant, or nearly constant, velocity until one-way clutch 62 disengages. The one-way clutch disengages at or near point Eo, the exhaust valve opening point. The force generated by the compression stroke of the plunger's bounce chamber and the opposed power piston decelerates the piston until its velocity reaches zero at bottom-center BC. The lower graph shows the power piston's acceleration during the downstroke. Note that acceleration drops to near zero after clutch engagement point e and increases in the negative direction after point Eo.

Figure 25:
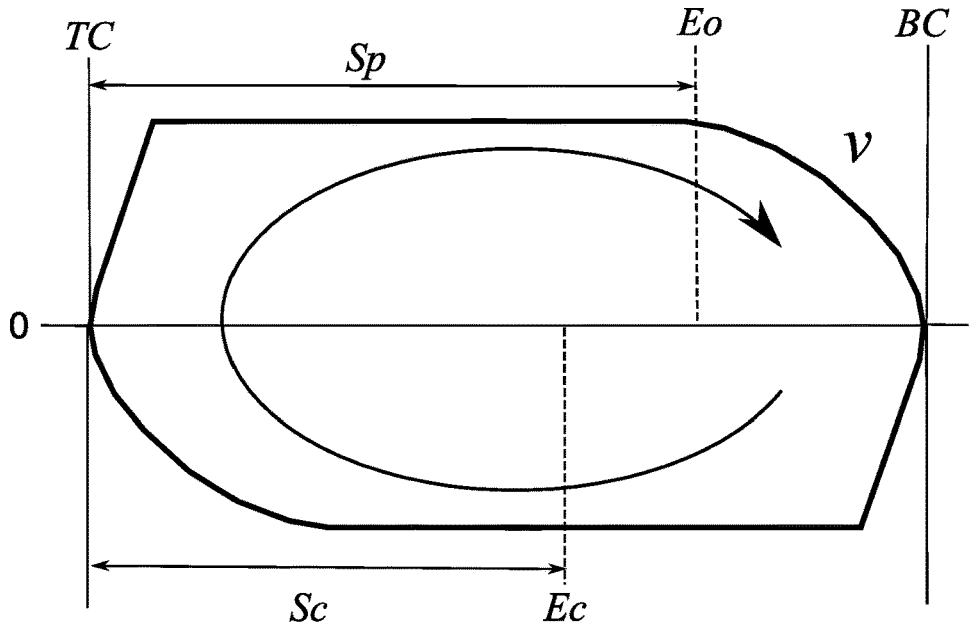
FIG. 25 is a graph of the velocity (v) versus displacement of an engine 100 power piston for the full engine cycle.

FIG. 25 shows a graph of power piston velocity for engine 100 for the entire engine cycle. The engine cycle repeats on the graph in the clockwise direction shown by the arrow. The upper curve depicts the power pistons downstroke and the lower curve depicts the piston's returning upstroke. Because of the mechanical linkage and the balanced reciprocation of the upper and lower plungers, the upstrokes and downstrokes are symmetric. That is, the piston's velocity curve on the upstroke is the mirror image of the piston's downstroke velocity curve. Point Ec on the piston's returning upstroke is the point that the exhaust valve closes and the compression stroke Sc begins. It should be noted that in some implementations the plunger may disengage from the output shaft and start the downstroke deceleration either before or after point Eo.

Figure 26:
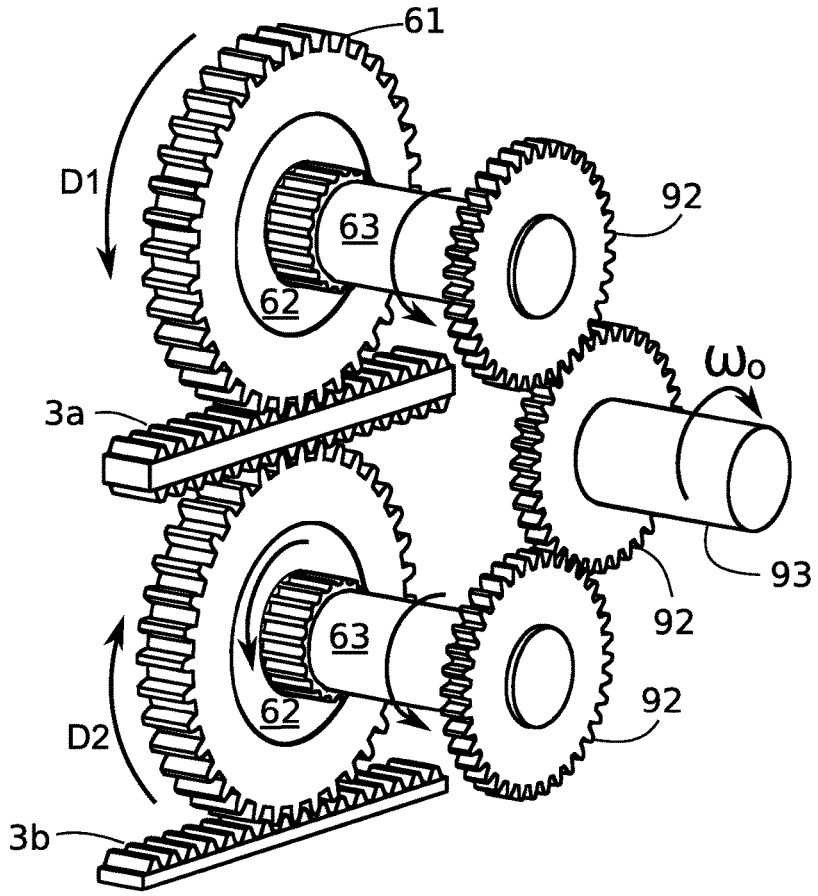
FIG. 26 is a perspective view of the gearing that links drive shaft 93 of engine 100 to output shafts 63.
Figure 27:
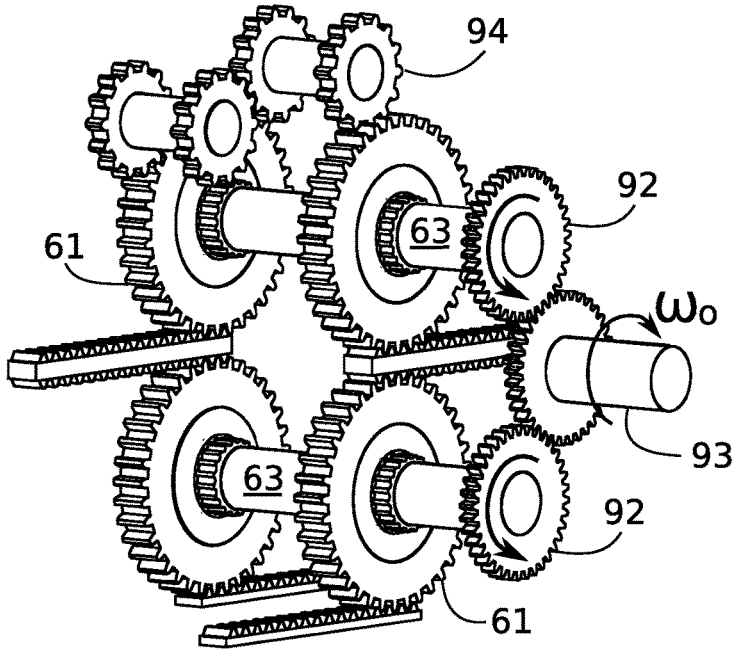
FIG. 27 is a perspective view of the gearing that links drive shaft 93 for a four cylinder version of engine 100, with synchronizer 94 coordinating four rack and pinions.

FIG. 26 is a perspective view of the transmission gearing of engine 100. Transmission gears 92 link output shafts 63 to drive shaft 93. Drive shaft rotation ωo is in direction D2. FIG. 27 is a perspective view of the transmission gearing for a four-cylinder version of engine 100, an engine providing four combustion chambers, four reciprocating plunger assemblies, four gear racks and pinions, etc. But as for the two-cylinder model, this four-cylinder model has only two output shafts 63. The upper output shaft 63 is driven by the one-way clutches of the two upper pinion gears 61. The lower output shaft is likewise driven by the two lower pinion gears. Synchronizing gears 94 synchronize the motions of the four reciprocating plungers. It should be noted that this same method may be used to implement a six-cylinder model, an eight-cylinder model, etc. In some applications an odd number of plungers may be workable, as for example a three-cylinder or five-cylinder model.

Figure 28:
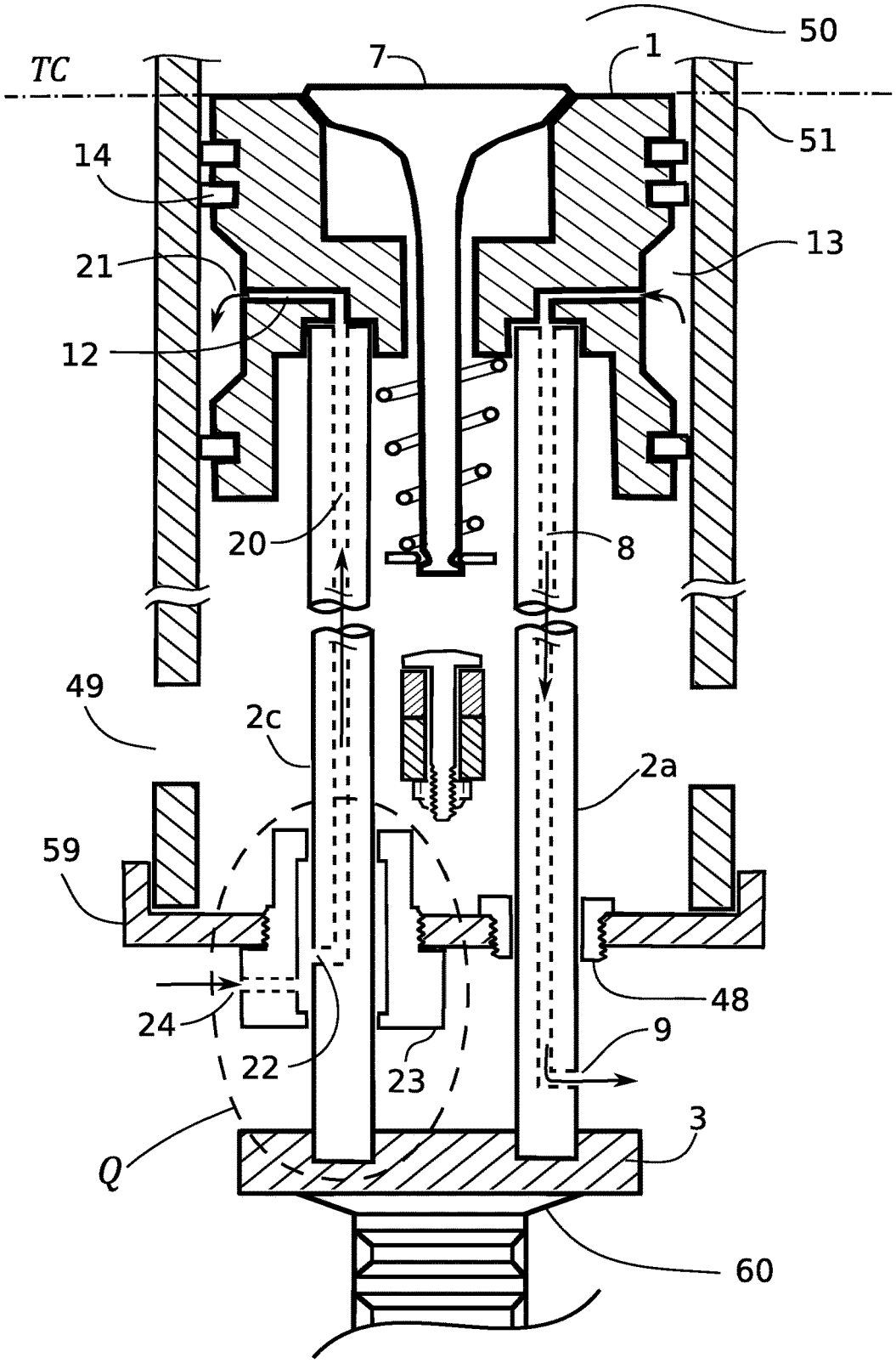
FIG. 28 is a partial cross sectional view of combustion cylinder 51 showing the operation of oiling sleeve 23 and operation of oil inflow channel 20 on plunger 60.

FIG. 28 is a longitudinal cross-section of a second mechanism for injecting oil into power piston oil cavity 13 of engine 100. This second mechanism includes oiling sleeve 23 and connecting rod 2*c*. Rod 2*c* provides an oil inflow channel 20. Oil outflow from cavity 13 is provided for as described above, through channel 8 in connecting rod 2*a*. Oiling sleeve 23 surrounds connecting rod 2*c* and allows sealed longitudinal movement of the connecting rod through the oiling sleeve. The oiling sleeve may replace one of the seals in the pumping head, seal 48, as shown. The oiling sleeve includes oil inlet 24 for connection to a source of pressurized lubricating oil. Connecting rod 2*c* includes oil inlet 22. Oil flows from the oiling sleeve inlet into channel 20 when oil inlet 22 enters the oiling sleeve. Oil flows from channel 20 through channel 12 of the power piston and is injected into cavity 13 at oil outlet 21.

Engine 100 may use either oiling sleeve 23 or the oil injector 44 for supplying cavity 13 with lubricating oil. The engine may also use both mechanisms. Oiling sleeve 23 may be arranged to operate when the piston is near top-center while injector 44 may operate near bottom-center. The use of both mechanisms will increase the flow of lubricating oil to the power piston as compared to as single mechanism, and may be beneficial in some applications.

Figure 29A:
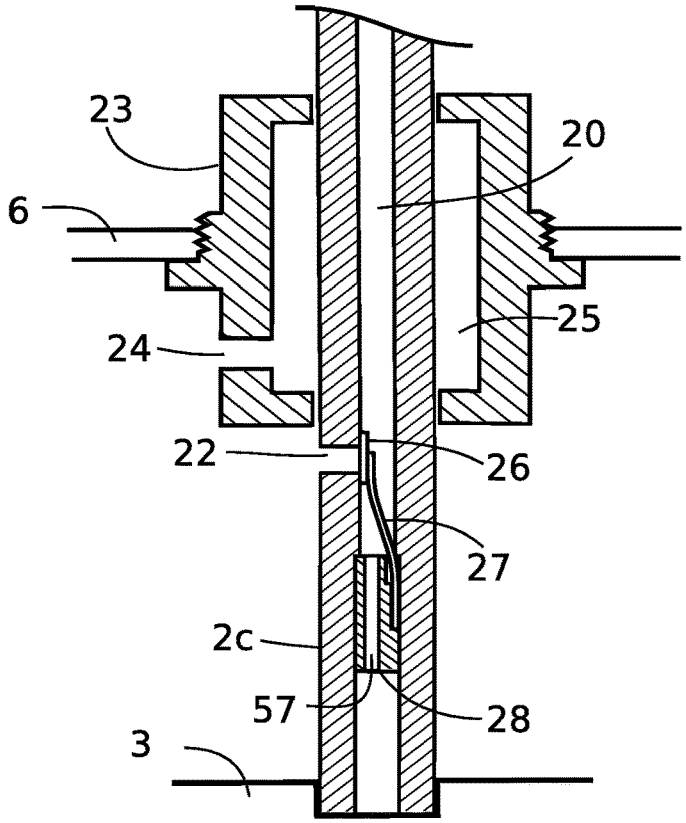
FIG. 29A is a detail view of section Q of FIG. 28 showing reed valve 26 in the closed position.
Figure 29B:
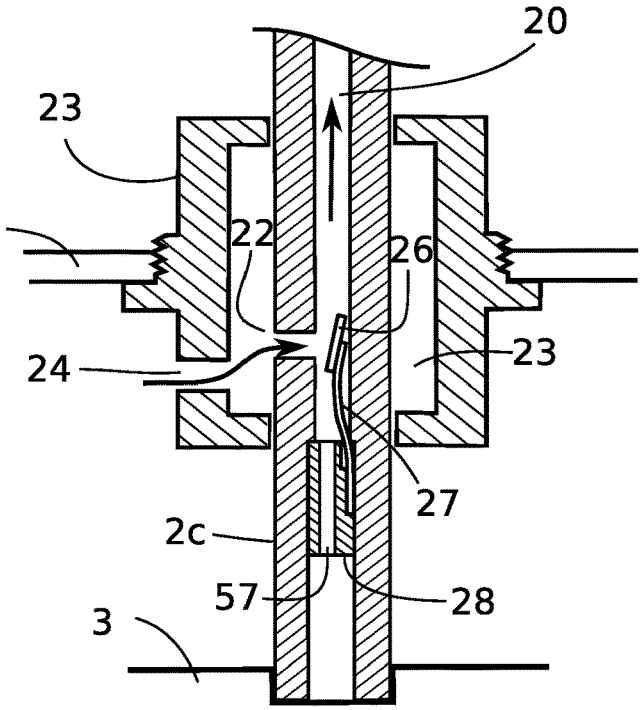
FIG. 29B is a detail view of section Q of FIG. 28 showing reed valve 26 in the open position.

FIG. 29A and FIG. 29B are expanded views of the area Q of FIG. 28. Oiling sleeve 23 includes interior oil cavity 25. The cavity allows oil flow into inlet 22 as the inlet transits through the length of the cavity. The figures also show the placement of an optional check valve in channel 20 of connecting rod 2*c*. The check valve may be useful for preventing oil leakage at inlet 22 when the inlet is moving outside the oiling sleeve. The check valve is a reed valve assembly comprising seal 26, spring 27 and fastener 28. Fastener 28 attaches spring 27 to the interior of channel 20 as shown. The fastener may optionally provide oil passage 57. FIG. 29A shows the reed valve in the closed position, sealing inlet 22. FIG. 29B shows the reed valve in the open position. When inlet 22 enters cavity 25, oil pressure applied at sleeve inlet 22 flexes spring 27 and opens the valve. If passage 57 is provided in the fastener, rod 2*c* may include multiple inlets and check valves to allow oil injection at multiple points. This method may be useful in applications requiring increased oil flow.

Figure 30:
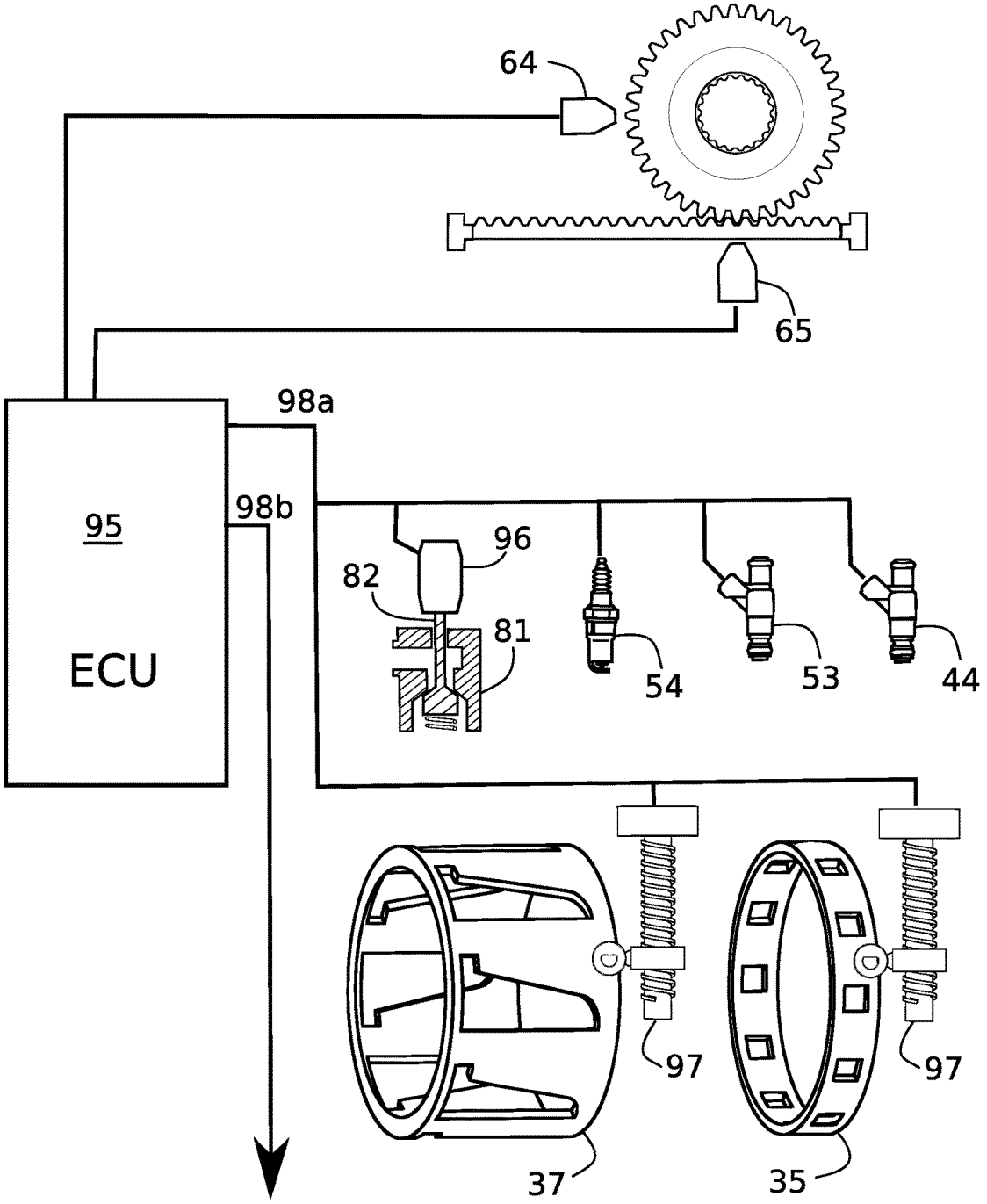
FIG. 30 shows a diagram of the functional inputs and outputs of engine 100's electronic control unit 95.

FIG. 30 shows a diagram of engine 100's Electronic Control Unit (ECU) functionality. ECU 95 receives continuous readings of the position of the engine's reciprocating racks and pinions from sensor 64. ECU 95 receives continuous readings of the velocity of the engine's reciprocating racks from sensor 65. Any method known in the art for sensing the position and speed of these parts may be used. For example, optical sensors may be used in reading the rotational position of one of the engine's pinion gears and magnetic sensors may be used to read the speed of one of the engine's gear racks. (A single position sensor with a high enough sample rate may, of course, also provide the velocity data.) With these inputs, along with other inputs common for electronic engine controls, the ECU determines and produces control signals to the engine components shown in FIG. 30. Lines 98*a* represent signals for operation of the upper combustion chamber and bounce assembly components. Lines 98*b* represent the signals for operation of the lower combustion chamber and bounce assembly components. Solenoid 96 represents the mechanism for operating release plunger 82 of valve actuator release valve 81. ECU 95 also controls the timing of spark plugs 54 and fuel injectors 53. Step motor and worm screw assembly 97 represents the mechanism for positioning of idle sleeve valve 35 and power sleeve valve 37 via ECU control. Engine 100 includes oil injector 44 which operates under control of the ECU. Mechanical mechanisms for switching of oil injector 44 are not precluded, however. Mechanical switching mechanisms for injector 44 could make ECU control of the injector unnecessary.

Alternative embodiments of the present invention will now be disclosed. The scavenging and lubrication methods employed in engine 100 are advantageous in regards to exhaust emissions and efficiency. Other standard methods for scavenging and lubrication are not precluded, however. For example, FIG. 31 shows the combustion chamber of an embodiment in which cylinder ports 49 are opened to combustion chamber 50 when power piston 1 travels inboard of the port, a common configuration. In this configuration lubrication is commonly provided by mixing oil with the air-fuel mixture. Cylinder ports 49 may also be either intake or exhaust ports in this configuration. For example, poppet valve 55 may be employed as the intake valve with carborated fueling used in place of fuel injector 53. Additionally, poppet valves located in the combustion head may be used for both exhaust and intake ports. This configuration would employ loop or cross scavenging. Additionally, some embodiments of the present invention may employ compression ignition instead of spark ignition. That is, the present invention may be implemented as a diesel engine. Spark plugs 54 would not be included when employing compression ignition.

FIG. 32 shows an alternative method for expanding engine 100 to a four cylinder engine. In this method synchronizing gears, as employed in FIG. 27, are not required for synchronizing the motion of the four reciprocating plungers. Four pinion gears engage four gear racks in a vertical arrangement as shown.

Figure 33:
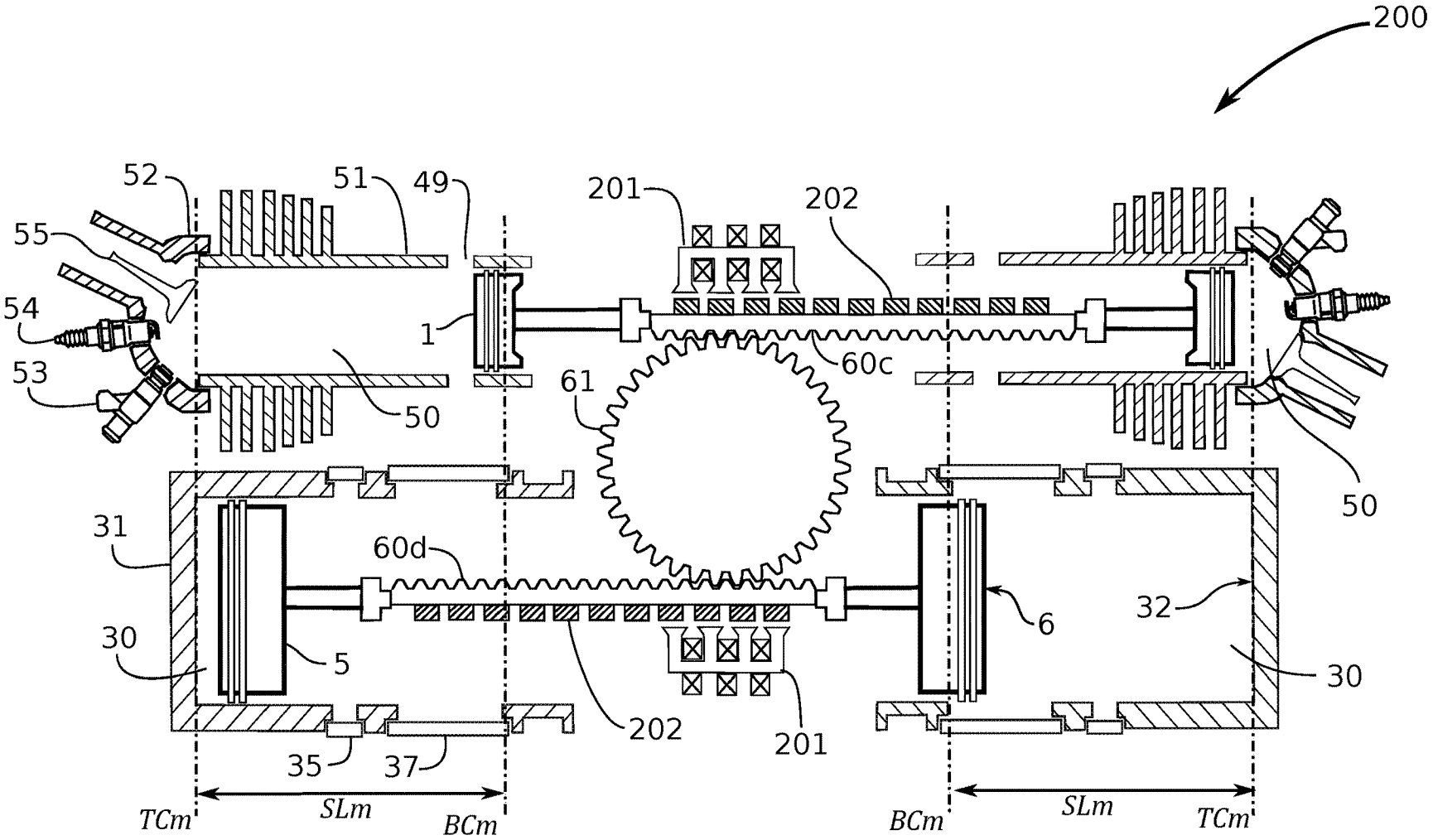
FIG. 33 is a partial longitudinal view of an alternative embodiment of the present invention, engine 200.

FIG. 33 shows a further alternative embodiment of the present invention, engine 200. Engine 200 employs linear electric generators instead of one-way clutches for harnessing power from the combustion chambers. A single pinion gear 61 serves as the mechanical linkage between the upper and lower plungers. Magnets 202 attached to plungers 60*c* and 60*d* generate power in stator and coil assemblies 201. Many other linear generator configurations are known in the art and may be incorporated in the present invention. Engine 200 is configured with the upper plunger 60*c* reciprocating between two combustion chambers 50, and with the lower plunger 60*d* reciprocating between two bounce chambers 30. The engine may also be configured with each plunger having one power piston and one bounce piston as with engine 100.

Figure 34:
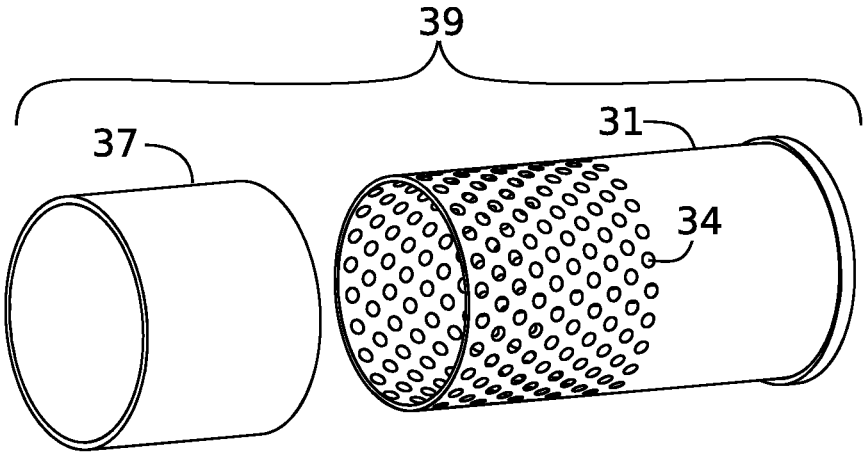
FIG. 34 is an exploded view of an alternative embodiment of bounce assembly 39.
Figure 35A:
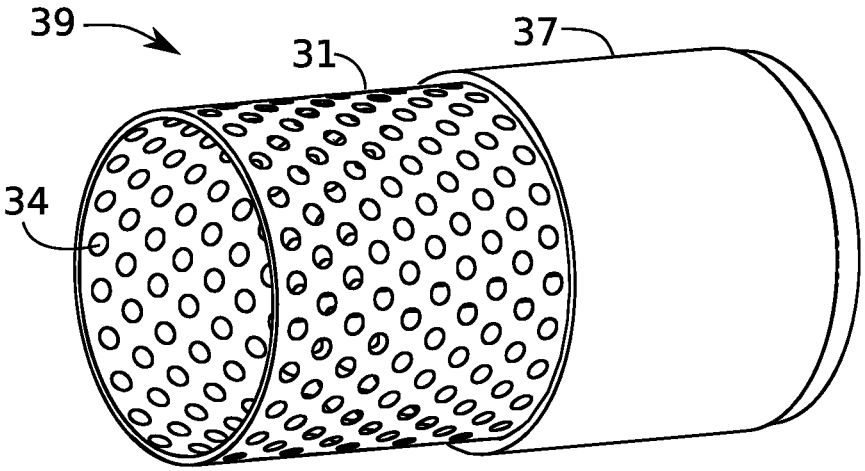
FIG. 35A is a perspective view of the alternative bounce assembly of FIG. 34 with power sleeve 37 shown in the fully open operating position.
Figure 35B:
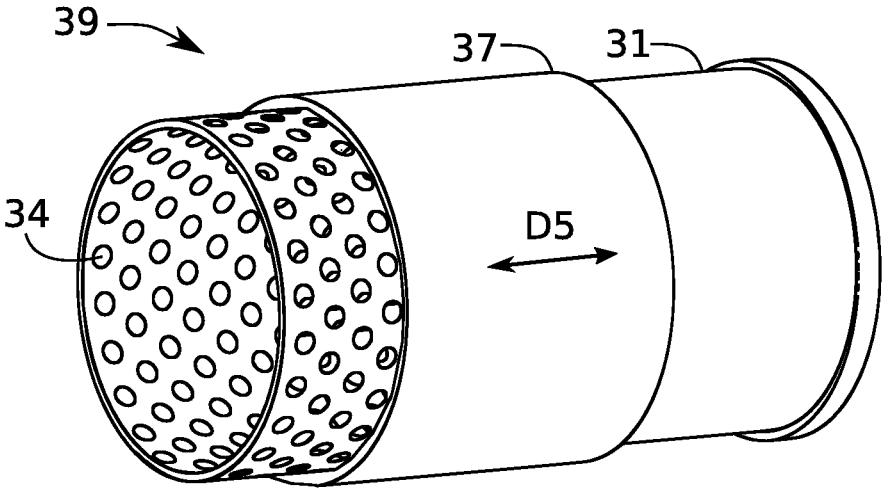
FIG. 35B is a perspective view of the alternative bounce assembly of FIG. 34 with power sleeve 37 shown in a partially closed operating position.

FIG. 34 is an exploded view an alternative embodiment of bounce assembly 39. The function of idle sleeve valve 35 and power sleeve valve 37 of the previously detailed bounce chamber are accomplished with a single sleeve valve 37 in this alternative embodiment. Bounce cylinder 31 provide ports 34 in the form of circular openings as shown. Sleeve valve 37 is the cylindrical sleeve that controls the spring constant K of the bounce chamber. Adjustment of the K value is accomplished by sliding the sleeve valve longitudinally over slots 34 as opposed rotating the sleeve valve as in previous described embodiment. FIG. 35A is a perspective view of the alternate chamber with sleeve valve 37 placed in its fully opened position. The fully opened position provides the lowest system resonant frequency and, therefore, the slowest engine cycle rate. FIG. 35B shows the sleeve valve 37 slid longitudinally in direction D5 to a middle position. Therefore some of slots 34 are blocked and more air is trapped in the bounce chamber during the bounce piston's upstroke. The mechanism for adjusting the position of the sleeve valve, under control of the engine's ECU, is not shown.

Figure 36A:
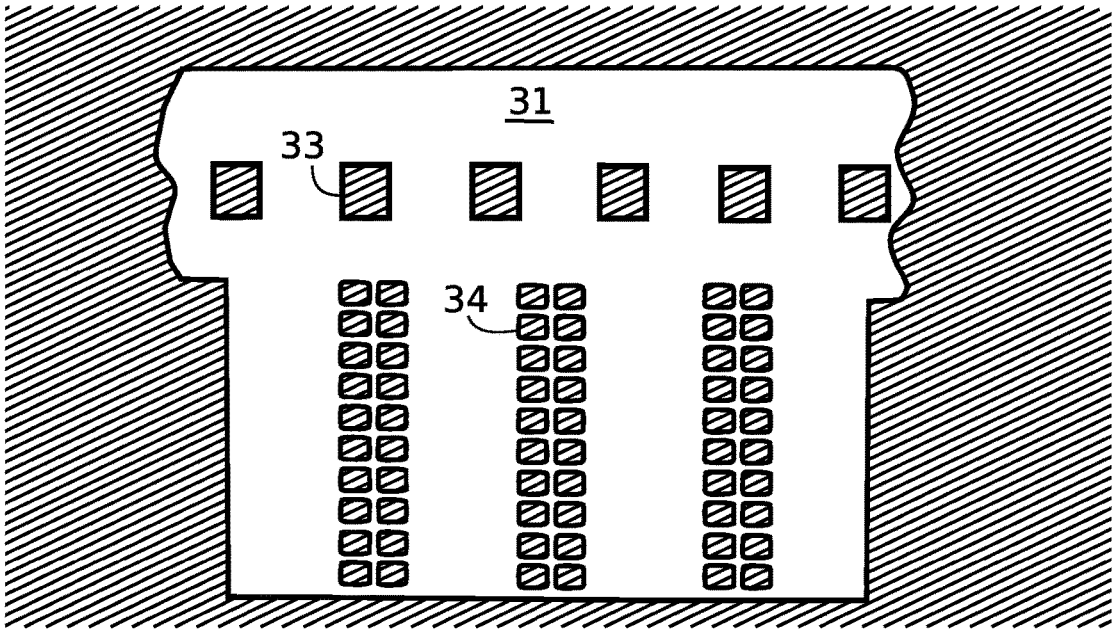
FIG. 36A shows a flattened section of bounce cylinder 31 with an alternative configuration of power ports 34.
Figure 36B:
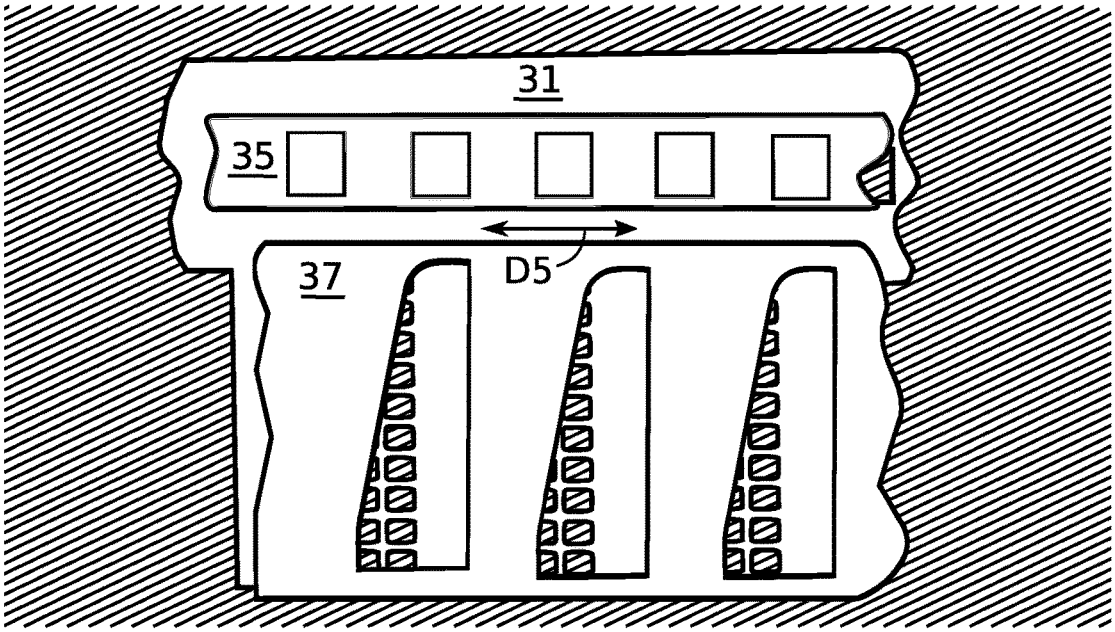
FIG. 36B shows the alternatively configured ports of FIG. 36A with power sleeve valve 37 shown in an operating position.

The disclosure of the present invention does not preclude additional configurations of the ports and valves comprising the control mechanism of bounce assembly 39. For example, FIG. 36A shows a flattened section of yet another alternative embodiment of bounce cylinder 31. Ports 34 of this cylinder comprises a pattern of cut-outs as shown. FIG. 36B shows the power sleeve 37 in a partially closed position. The invention could even include a valve in the bounce chamber ceiling or in the outboard end of the bounce cylinder. For example, a poppet valve could be disposed in a cylinder head comprising a component of the bounce assembly. Such a configuration would require opening and closing of the poppet valve each engine cycle with precise timing. Although this configuration would incur significant pumping loss, it could be practical in some applications.

It should be understood that the drawings of the disclosure are schematic in nature and may not be to scale. For example, the relative sizes of the engine's power and bounce pistons, and the lengths of the combustion and bounce chambers may differ from that depicted in the drawings. The number, size and shape of the bounce piston ports may vary from the depictions in the drawings. In practice the pinion gears may engage the gear racks over a small rotational angle, and therefore the pinions may not have gear teeth along their full circumference. The size and shape of the power piston oil cavity 13 may vary from that shown in the illustrations. The shape, nature and size of the one-way clutches implemented in practice may vary from the simplified depictions of clutches 62 depicted in these drawings. In general, features such as proportions, shapes, sizes, lengths, spacing, widths, gaps and contact surfaces may be exaggerated or otherwise altered for the sake of clarity.

LIST OF REFERENCE NUMERALS

1 power piston
2 power piston connecting rod
3 gear rack
4 bounce piston connecting rod
5 bounce piston
6 bounce piston top surface
7 intake valve
8 connecting rod oil outflow channel

9 connecting rod oil outlet
10 linear cam
11 piston oil inlet
12 piston oil channel
13 piston oil cavity
14 piston ring
15 piston body
16 piston insert
17 air vane
18 connecting rod socket
19 power piston air passage
20 connecting rod oil inflow channel
21 piston oil outlet
22 connecting rod oil inlet
23 oiling sleeve
24 oiling sleeve inlet
25 oiling sleeve cavity
26 oil channel reed valve seal
27 oil channel reed valve spring
28 oil channel reed valve fastener
29 intake valve spring
30 bounce chamber
31 bounce cylinder
32 bounce chamber ceiling
33 bounce cylinder idle port
34 bounce cylinder power port
35 idle sleeve valve
36 idle sleeve valve opening
37 power sleeve valve
38 power sleeve valve opening
39 bounce assembly
40 idle sleeve retaining ring
41 power sleeve retaining ring
42 control peg
43 anchor peg
44 oil injector
45 intake check valve (reed valve)
46 intake reservoir case
47 intake cavity
48 pumping head connecting rod seal
49 combustion cylinder port
50 combustion chamber
51 combustion cylinder
52 combustion head
53 fuel injector
54 spark plug
55 exhaust valve
56 exhaust valve spring
57 reed valve fastener oil passage
58 pumping chamber
59 pumping head
60 reciprocating plunger
61 pinion gear
62 one-way clutch
63 output shaft
64 position sensor
65 velocity sensor
66 valve rocker arm
67 intake valve stop
68 intake valve rubber
69 intake valve stop support
70 cam rocker
71 cam rocker stop
72 push rod
73 cam actuator (CA)
74 check valve—cam actuator
75 hydraulic line
76 hydraulic piston—cam actuator
77 pressure chamber—cam actuator
78 oil inlet—cam actuator
79 oil outlet—cam actuator
80 valve actuator (VA)
81 release valve—valve actuator
82 release valve plunger
83 purge outlet
84 check valve—valve actuator
85 purge passage—valve actuator
86 hydraulic piston—valve actuator
87 pressure chamber—valve actuator
88 purge channel—valve actuator
89 oil release outlet—valve actuator
90 oil inlet—valve actuator
91 screw—pumping head to valve stop support
92 transmission gears—output shafts to drive shaft
93 drive shaft
94 plunger synchronizer
95 Electronic Control Unit (ECU)
96 release valve plunger solenoid
97 sleeve valve controller—step motor/worm gear
201 stator/coil assembly of linear electric generator
202 magnets of linear electric generator
BC inboard piston reversal point
BCm maximum inboard piston reversal point
CR Compression Ratio
D1 clutch locking rotational direction
D2 clutch free-wheeling rotational direction
D3 first longitudinal direction
D4 second longitudinal direction
D5 directions of operation of sleeve valves
Eo exhaust valve opening point
Ec exhaust valve closing point
Gi intake gas
Gx air fuel mixture or combustion products
Ic intake valve closing point
Io intake valve opening point
K system spring constant
Sc compression stroke
SL stroke length
SLm maximum stroke length
Sp power stroke
TC outboard piston reversal point
TCm maximum outboard piston reversal point The invention I claim is:

1. A two-stroke internal combustion free-piston engine comprising:

two or more reciprocating gear racks;

two or more power pistons;

two or more bounce pistons;

a power cylinder for each power piston arranged with its power piston reciprocating within the power cylinder;

a power head for each power cylinder for enclosing the outboard side of the power cylinder to form a combustion chamber;

a bounce chamber for each bounce piston comprising a bounce cylinder and bounce cylinder ceiling, arranged with its bounce piston reciprocating within the bounce cylinder, and arranged to trap and compress a mass of air within the bounce chamber during the bounce piston's upstroke;

a bounce valve for each bounce chamber arranged to vary the mass of air trapped within the bounce chamber during its bounce piston's upstroke;

at least one pinion gear engaging the gear racks and arranged so that the reciprocating motion of each gear rack produces an opposing reciprocating motion of at least one other gear rack;

wherein each said power piston is connected to a said gear rack and each said bounce piston is connected to a said gear rack, with the power pistons and the bounce pistons and the gear racks arranged to form at least two reciprocating plungers;

wherein said plungers and said bounce chambers and said combustion chambers and said at least one pinion gear are arranged so the compression stroke of each power piston is mechanically linked to the compression stroke of at least one bounce piston.

2. The two-stroke internal combustion free-piston engine of claim 1 wherein said bounce valve comprises one or more air ports disposed on said bounce cylinder and one or more sleeve valves slidable over the air ports, arranged so that the mass of the air trapped during said bounce piston compression stroke is selectable by the positioning of the one or more sleeve valves.

3. The two-stroke internal combustion free-piston engine of claim 1 wherein:

the surfaces of said bounce piston top and said bounce chamber ceiling are shaped so that the bounce piston and bounce chamber ceiling do not make contact during the bounce piston upstroke until the volume within said bounce chamber approaches zero;

wherein the position of said bounce chambers are arranged so that the maximum outboard travel of said power pistons is determined by the position of at least one of the bounce chamber ceilings.

4. The two-stroke internal combustion free-piston engine of claim 1 that further includes a gas valve mechanism comprising:

a poppet valve for opening and closing a gas port situated in said combustion chamber head;

a valve spring that urges the poppet valve toward the closed position;

a linear cam disposed on a said reciprocating plunger;

a cam rocker arm arranged so that reciprocating motion of said plunger causes the linear cam to engage and operate the cam rocker arm;

a valve rocker arm engaging the poppet valve;

a push rod engaging the cam rocker arm and the valve rocker arm;

wherein said cam rocker arm and said push rod and said valve rocker arm are arranged so that operation of the cam rocker aim causes operation of said poppet valve.

5. The two-stroke internal combustion engine free-piston of claim 1 that further includes a gas valve mechanism comprising:

a poppet valve for opening and closing a gas port situated in said combustion chamber head;

a valve spring that urges the poppet valve toward the closed position;

a linear cam disposed on a said reciprocating plunger;

a cam rocker arm arranged so that reciprocating motion of said plunger causes the linear cam to engage and operate the cam rocker arm;

a hydraulic cam actuator comprising a pressure chamber, a piston, an inlet to the pressure chamber, a check valve for the inlet, and an outlet to the pressure chamber;

a hydraulic valve actuator comprising a pressure chamber, a piston, an inlet to the pressure chamber, a check valve for the inlet, a release outlet to the pressure chamber, a purge channel to the pressure channel, and a purge outlet;

a purge passage disposed in or on said valve actuator piston arranged to block said purge outlet when the piston is extended and to open said purge outlet when the piston is in retracted;

a release valve for opening and closing the valve actuator release outlet, arranged to operate by an external signal;

a hydraulic line for transmitting hydraulic force from the cam actuator to the valve actuator;

a push rod engaging the cam rocker arm and the cam actuator;

wherein said cam actuator and valve actuator and hydraulic line are arranged so that oil applied at a purging pressure to the cam actuator inlet, when said valve actuator piston is retracted or when said release valve is open, fills with oil said cam actuator pressure chamber and said hydraulic line and said valve actuator pressure chamber;

wherein said cam actuator and push rod are arranged so that oil applied at a purging pressure to said cam actuator inlet urges said cam rocker aim to rotate toward its closed position;

wherein said cam actuator and push rod are arranged to produce hydraulic force when said cam rocker arm is engaged and operated by said linear cam;

wherein said valve actuator is arranged to open said poppet valve when said hydraulic force is transmitted from said cam actuator through said hydraulic line to the valve actuator;

wherein said valve actuator and release valve are arranged to hold said poppet valve in the open position after said hydraulic force diminishes, and is arranged to allow the poppet valve to close when said release valve is operated by said external signal.

6. The two-stroke internal combustion free-piston engine of claim 1 that further includes a scavenging system comprising:

a pumping head covering the inboard side of each said power cylinder for enclosing a pumping chamber;

at least one connecting rod for each said power piston for connecting the power piston to a said gear rack;

a sealed opening for each connecting rod disposed in the pumping head, arranged for sealed linear movement of the connecting rod;

an intake reservoir case for each power cylinder arranged to provide an intake cavity;

at least one port in each pumping chamber allowing passage of air between the pumping chamber and the intake cavity to form a scavenging reservoir;

at least one inlet and inlet check valve for bringing air into each said scavenging reservoir on the upstroke of said power piston and for compression of air in said scavenging reservoir during said power piston down stroke.

7. The two-stroke internal combustion free-piston engine of claim 1 that further includes:

an intake gas passage disposed in said power piston for the flow of intake gas from the inboard side of said power piston into said combustion chamber;

an intake valve disposed in said power piston for closing and opening said intake gas passage.

8. The two-stroke internal combustion free-piston engine of claim 1 that further includes:

a connecting rod attaching said power piston to a said gear rack;

an oil channel disposed within the connecting rod;

one or more oil inlets disposed on the outer circumference of the connecting rod for providing a flow of oil into said oil channel;

at least one check valve for said oil inlet for the prevention of oil flow out of said oil inlet;

wherein said check valve comprises a reed valve disposed within said connecting rod.

9. The two-stroke internal combustion free-piston engine of claim 1 that further includes a lubrication system comprising:

a sealed piston oil cavity disposed on the circumference of said power piston;

at least one connecting rod for each power piston providing an oil outflow channel and an oil outlet disposed outside of said combustion cylinder;

a piston oil passage within said power piston for the outflow of oil from said piston oil cavity to said oil outflow channel;

an injector disposed on said combustion cylinder for injecting oil into said oil cavity.

10. The two-stroke internal combustion free-piston engine of claim 1 that further includes a lubrication system comprising:

a sealed piston oil cavity disposed on the circumference of said power piston;

at least one outflow connecting rod for each power piston providing an oil outflow channel and an oil outlet disposed outside of said combustion cylinder;

a piston outflow passage disposed within said power piston for the outflow of oil from said piston oil cavity to said oil outflow channel;

at least one inflow connecting rod for each power piston providing an oil inflow channel and at least one oil inlet to said oil inflow channel;

a piston inflow passage disposed within said power piston for the flow of oil from said oil inflow channel to said power piston oil cavity;

an oiling sleeve surrounding said inflow connecting rod and providing a cavity on the inside circumference of the oiling sleeve, with a sleeve oil inlet for providing a flow of pressurized oil to the oiling sleeve cavity, and arranged to allow sealed linear movement of the inflow connecting rod;

wherein said inflow connecting rod and said oiling sleeve and said outflow connection rod and said piston inflow passage and said piston outflow passage are arranged to provide a flow of oil into and out of said piston oil cavity.

11. The two-stroke internal combustion free-piston engine of claim 1 that further includes a power linkage comprising at least one one-way clutch arranged to engage a said pinion gear for the transfer of power to a rotating output shaft.

12. The two-stroke internal combustion free-piston engine of claim 1 that further includes a power linkage comprising a electromagnetic coupling of at least one said reciprocating plunger to a linear electric generator for production of electric power.

* * * * *